US006998623B2

(12) United States Patent
Usami et al.

(10) Patent No.: US 6,998,623 B2
(45) Date of Patent: Feb. 14, 2006

(54) SHEETS FLUORESCENCE DETECTING SENSOR

(75) Inventors: Kouyou Usami, Itabashi-ku (JP); Hideaki Kamijo, Saitama (JP); Kazunori Hirose, Itabashi-ku (JP); Yukio Kozaki, Itabashi-ku (JP)

(73) Assignee: Nidec Copal Corporation, Tokyo (JP)

( * ) Notice: Subject to any disclaimer, the term of this patent is extended or adjusted under 35 U.S.C. 154(b) by 214 days.

(21) Appl. No.: 10/474,705

(22) PCT Filed: Feb. 27, 2003

(86) PCT No.: PCT/JP03/02256

§ 371 (c)(1),
(2), (4) Date: Oct. 10, 2003

(87) PCT Pub. No.: WO03/073384

PCT Pub. Date: Sep. 4, 2003

(65) Prior Publication Data

US 2004/0129893 A1 Jul. 8, 2004

(30) Foreign Application Priority Data

| | | |
|---|---|---|
| Feb. 28, 2002 | (JP) | 2002-054098 |
| Mar. 7, 2002 | (JP) | 2002-062471 |
| Apr. 3, 2002 | (JP) | 2002-101670 |
| Feb. 7, 2003 | (JP) | 2003-030759 |

(51) Int. Cl.
*G07D 7/12* (2006.01)

(52) U.S. Cl. ..... 250/461.1; 250/459.1

(58) Field of Classification Search ..... 250/461.1, 250/459.1, 559.01; 356/417, 317
See application file for complete search history.

(56) References Cited

U.S. PATENT DOCUMENTS

| | | | | |
|---|---|---|---|---|
| 4,451,521 | A | 5/1984 | Kaule et al. | |
| 5,491,336 | A * | 2/1996 | Concannon et al. | 250/228 |
| 5,667,888 | A * | 9/1997 | Yoshida et al. | 428/336 |
| 5,918,960 | A | 7/1999 | Hopwood et al. | |
| 6,024,202 | A * | 2/2000 | Potter | 194/207 |
| 6,297,509 | B1 * | 10/2001 | Lipkowitsch et al. | 250/461.1 |
| 6,369,882 | B1 * | 4/2002 | Bruner et al. | 356/73 |
| 6,570,653 | B1 * | 5/2003 | Bruner et al. | 356/417 |
| 6,778,276 | B1 * | 8/2004 | Bruner et al. | 356/417 |

FOREIGN PATENT DOCUMENTS

| | | |
|---|---|---|
| JP | 6-333127 | 12/1994 |
| JP | 10-40436 | 2/1998 |
| JP | 2001-74659 | 3/2001 |

* cited by examiner

*Primary Examiner*—Otilia Gabor
(74) *Attorney, Agent, or Firm*—Leydig, Voit & Mayer, Ltd.

(57) ABSTRACT

A paper sheet fluorescence sensor utilizes an ultraviolet-reflecting filter to orthogonally irradiate a conveying path with ultraviolet light and receive fluorescence from a paper sheet. The ultraviolet-reflecting filter reflects ultraviolet light emitted from an ultraviolet light source, to produce light having an optical axis orthogonal to the conveying path of the paper sheet. The light transmitted through the ultraviolet-reflecting filter is detected by a fluorescence detecting device. An ultraviolet-transmitting filter is disposed between the ultraviolet-reflecting filter and the ultraviolet light source, so that the light reflected by the ultraviolet-reflecting filter attains a higher ultraviolet content, thereby improving light-detection accuracy.

14 Claims, 17 Drawing Sheets

SHEETS FLUORESCENCE DETECTING SENSOR

TECHNICAL FIELD

The present invention relates to a paper sheet fluorescence sensor to be utilized for determining kinds of paper sheets such as bills and whether they are authentic or not.

BACKGROUND ART

As a technique in such a field, Japanese Translated PCT Application Laid-Open No. HEI 9-507326 has conventionally been known. The apparatus disclosed in this publication irradiates a bill with an ultraviolet ray, measures the level of ultraviolet light reflected by the bill with a first photocell and the amount of fluorescence generated by the bill with a second photocell at the same time, and compares the respective measured amounts with reference levels, so as to determine whether the bill is authentic or not.

However, the following problem exists in the above-mentioned conventional apparatus. Namely, while the light can be received relatively well against flopping of the bill on its conveying path when the bill is obliquely irradiated with the ultraviolet ray from thereabove, an area required in the bill may not sufficiently be irradiated with the ultraviolet ray if the bill is wrinkled or bent. In this case, the generated fluorescence may fluctuate, whereby the output by receiving fluorescence may become uneven, thus making it difficult to receive the fluorescence accurately.

In particular, it is an object of the present invention to provide a paper sheet fluorescence sensor which can accurately detect the fluorescence generated by paper sheets while not being easily influenced by the states of paper sheets.

DISCLOSURE OF THE INVENTION

The present invention provides a paper sheet fluorescence sensor for irradiating a paper sheet with light while conveying the paper sheet, and detecting fluorescence emitted from the paper sheet; the sensor comprising an ultraviolet light source accommodated in a housing; an ultraviolet-reflecting filter, accommodated in the housing, for reflecting light emitted from the ultraviolet light source so as to irradiate a conveying path of the paper sheet orthogonally; an ultraviolet-transmitting filter disposed between the ultraviolet light source and the ultraviolet-reflecting filter; and a fluorescence-receiving device, accommodated in the housing, for receiving by way of the ultraviolet-reflecting filter the fluorescence emitted from the paper sheet upon irradiation with an ultraviolet ray.

The present invention is based on the presupposition that the paper sheet fluorescence sensor irradiates a paper sheet with an ultraviolet ray and receives the fluorescence emitted from the paper sheet with the fluorescence-receiving device so as to determine the kind of the paper sheet, whether the paper sheet is authentic or not, etc. On the conveying path, the paper sheet is not always conveyed in a constant state but may be flopped. Also, the paper sheet itself may be wrinkled or bent. The output from the fluorescence-receiving device is required to be hard to become uneven in any of such states. Hence, for orthogonally irradiating the conveying path with the ultraviolet ray and appropriately receiving the fluorescence from the paper sheet at the same time, an ultraviolet-reflecting filter is utilized in the present invention. The ultraviolet-reflecting filter reflects the light emitted from the ultraviolet light source, and produces a light beam having an optical axis orthogonal to the conveying path of the paper sheet. The fluorescence emitted from the paper sheet upon irradiation with the light beam is transmitted through the ultraviolet-reflecting filter, so as to be received by the fluorescence-receiving device. Further, the ultraviolet-transmitting filter is disposed between the ultraviolet-reflecting filter and the ultraviolet light source in the present invention, so that the light reflected by the ultraviolet-reflecting filter attains a higher ultraviolet content, thereby improving the light-receiving accuracy.

BEST MODES FOR CARRYING OUT THE INVENTION

In the following, preferred embodiments of the paper sheet fluorescence sensor in accordance with the present invention will be explained in detail with reference to the drawings.

[I]

Figure 1:
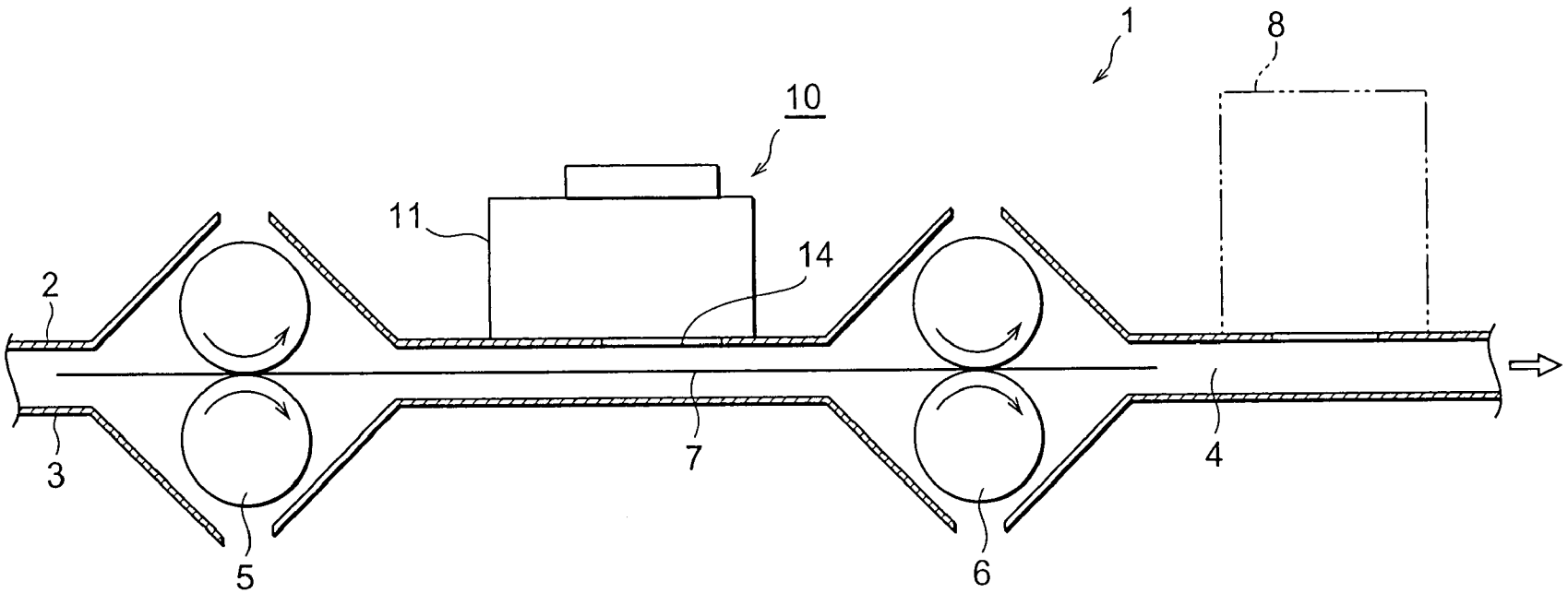
FIG. 1 is a sectional view showing an example of a paper sheet tester employing a paper sheet fluorescence sensor in accordance with the present invention.

FIG. 1 is a sectional view showing a paper sheet tester 1. The paper sheet tester 1 determines whether bills, which are an example of paper sheets, are authentic or not. Specifically, the tester discriminates color-copied counterfeit bills and normal bills from each other. Since color-copying paper includes a large amount of fluorescent ingredients, whether bills are authentic or not is determined while taking account of this fact.

The paper sheet tester 1 is provided with a linear conveying path 4 formed so as to be held between upper and lower guide plates 2, 3, whereas conveying rollers 5, 6 are disposed in the conveying path 4, so as to convey a bill 7 reliably to the exit side. In such a conveying path 4, a bill identifying unit 8 for identifying kinds of bills is disposed.

The bill (paper sheet) identifying unit 8 has such a structure that the bill 7 is irradiated with a light source such as LED whereas the reflected light from the bill 7 is captured by a CCD camera. Then, the image captured by the camera and known image data are compared with each other, so as to determine the kind of the bill. With a higher accuracy in color copying, however, it has recently become hard to determine whether the bill 7 is authentic or not according to image recognition alone.

Figure 2:
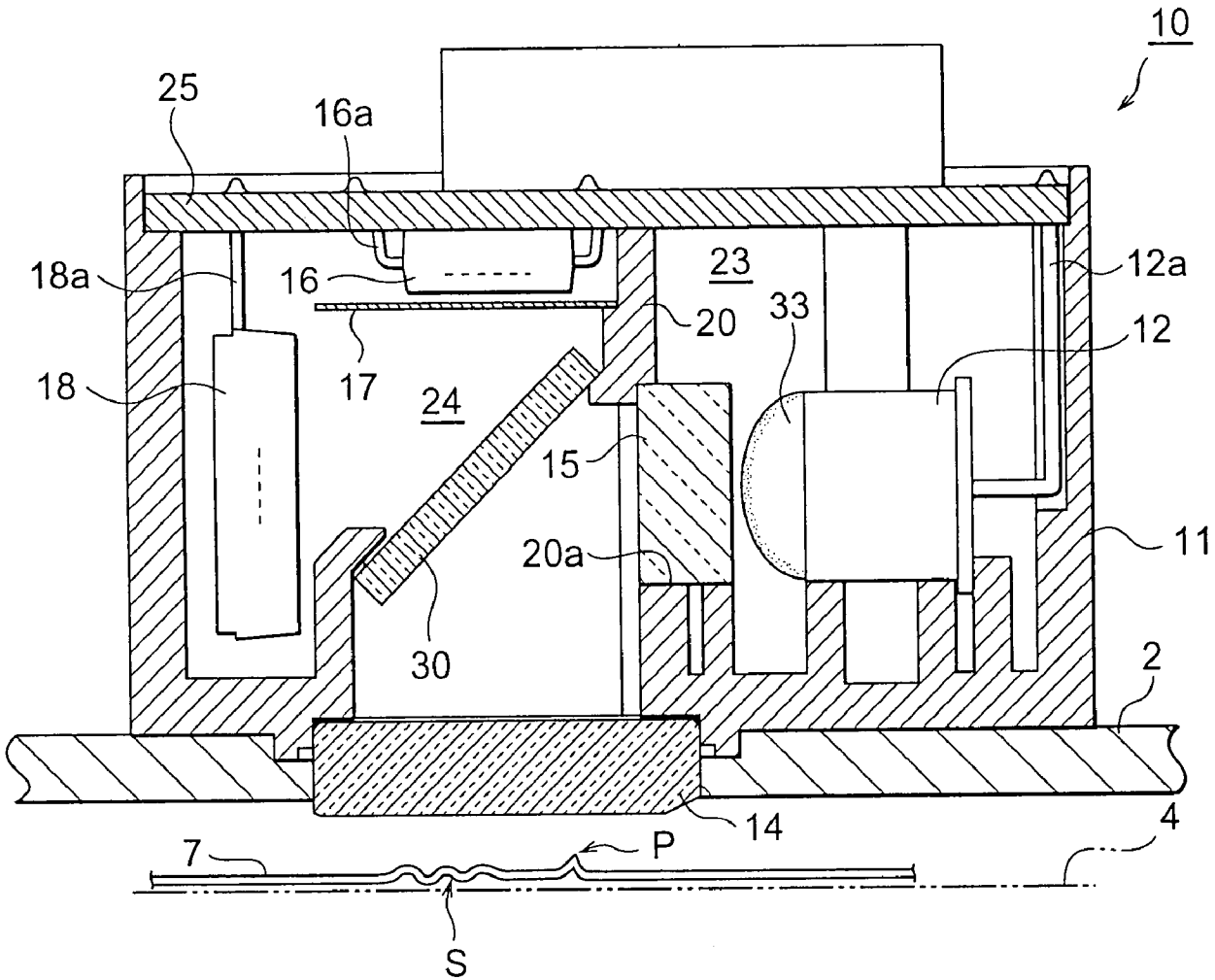
FIG. 2 is a sectional view showing a first embodiment of the paper sheet fluorescence sensor in accordance with the present invention.

Therefore, a paper sheet fluorescence sensor 10 is disposed upstream of the bill identifying unit 8. As shown in FIG. 2, the paper sheet fluorescence sensor 10 has a vertical partition 20 for dividing the inner space of a substantially rectangular parallelepiped housing 11. The partition 20 separates an ultraviolet light source 12 and a fluorescence-receiving device 16 from each other, and divides the housing 11 into a first chamber 23 and a second chamber 24. In the housing 11, the first chamber 23 formed by the partition 20 accommodates the ultraviolet light source 12 constituted by an ultraviolet LED (light-emitting device). The ultraviolet LED 12 is secured to a driving circuit board 25 attached to the housing 11 with an L-shaped lead part 12*a*. The ultraviolet light source 12 utilized here is an ultraviolet lamp including a visible light component. The LED is employed as the light source because of such merits that the accommodation space is saved even when the housing 11 is small, the unevenness in luminance is small, and the optical fluctuation over time is little, and thus is optimal for the paper sheet fluorescence sensor 10 intended to be made smaller.

The fluorescence-receiving device (photosensor) 16 for detecting the fluorescence released from the bill 7 is accommodated in the second chamber 24. The light-receiving device 16 has a lead part 16a secured to the driving circuit board 25. A dustproof glass sheet 14 is secured to the lower face of the housing 11 with an adhesive or the like, so as to close the second chamber 24. For the dustproof glass sheet 14, a glass material which is easy to transmit ultraviolet rays therethrough is employed. At an opening 20*a* of the partition 20, an ultraviolet-transmitting filter 15 is secured to the housing 11 with an adhesive or the like. The ultraviolet-transmitting filter 15 cuts off a visible light wavelength component at about 400 nm or longer, so as to eliminate the visible light component included in the ultraviolet LED 12, thereby enabling efficient ultraviolet irradiation. Hence, the light emitted from the ultraviolet LED 12 passes through the ultraviolet-transmitting filter 15, thereby releasing ultraviolet light having a wavelength such as the one indicated by L in FIG. 5 into the second chamber 24. Employing such an ultraviolet-transmitting filter 15 enhances the ultraviolet content and improves the light-receiving accuracy.

When detecting the fluorescence emitted from the bill 7 by utilizing the ultraviolet light source 12 and the fluorescence-receiving device 16, the bill 7 is not always. conveyed in a constant state but may be flopped on the conveying path 4. Also, the bill 7 itself may incur a wrinkle S or a bent P. Even in such a state, the output from the fluorescence-receiving device 16 is required to be harder to become uneven.

Therefore, an ultraviolet-reflecting filter 30 is utilized for orthogonally irradiating the conveying path 4 and appropriately receiving the fluorescence from the bill 7 at the same time. The ultraviolet-reflecting filter 30 is secured to the housing 11 within the second chamber 24 with such an angle (e.g., 45 degrees with respect to the conveying path 4) that the ultraviolet ray emitted from the ultraviolet light source 12 having an optical axis R1 (see FIG. 3) parallel to the conveying path 4 is bent by 90 degrees. As a consequence, the ultraviolet ray illuminates the bill 7 with an optical axis R2 (see FIG. 3) orthogonal to the conveying path 4. The light-receiving device 16 is disposed on the optical axis R2 orthogonal to the conveying path 4 and receives the light transmitted through the ultraviolet-reflecting filter 30.

Therefore, the flopping of the bill 7 on the conveying path 4 can be taken care of as a matter of course and, even if the wrinkles or bent P occurs in the bill 7, the irradiation of ultraviolet light can be restrained from becoming uneven in the part of wrinkle S or bent P, whereby the fluorescence does not fluctuate. As a result, the fluorescence-receiving accuracy can be raised. When the bill 7 illuminated with the ultraviolet ray includes a fluorescent ingredient, excited fluorescence is released from the bill 7 and is detected by the fluorescence-receiving device 16 after passing through the ultraviolet-reflecting filter 30 along the optical axis R2. For example, when a color-copied counterfeit bill 7 is fed into the conveying path 4, the light-receiving device 16 detects a large amount of fluorescence since color-copying paper includes a large amount of fluorescent ingredients. By contrast, normal bills hardly include fluorescent ingredients, whereby the light-receiving device 16 detects a very small amount of fluorescence.

Between the ultraviolet-reflecting filter 30 and the fluorescence-receiving device 16, an ultraviolet-absorbing filter 17 is secured to the inside of the housing 11 with an adhesive in front of the fluorescence-receiving device 16. Such an ultraviolet-absorbing filter 17 is employed, since fluorescence cannot be received accurately if a slight amount of ultraviolet ray is included in the light transmitted through the ultraviolet-reflecting filter 30.

Unless the quantity of light irradiating the bill 7 in the process of conveying is always regulated in a constant state, the bill 7 may not be inspected correctly (e.g., in terms of the kind of the bill and whether it is authentic or not). Therefore, as a means for regulation, an illumination monitor 18 constituted by a photosensor receives the light transmitted through the ultraviolet-reflecting filter 30. The illumination monitor 18 is accommodated in the second chamber 24 and is disposed on an extension of the optical axis R1 (see FIG. 3). The illumination monitor 18 has a lead part 18*a* secured to the driving circuit board 25. Therefore, the light emitted from the ultraviolet light source 12 is indirectly received by the illumination monitor 18 by way of the ultraviolet-reflecting filter 30.

Figure 3:
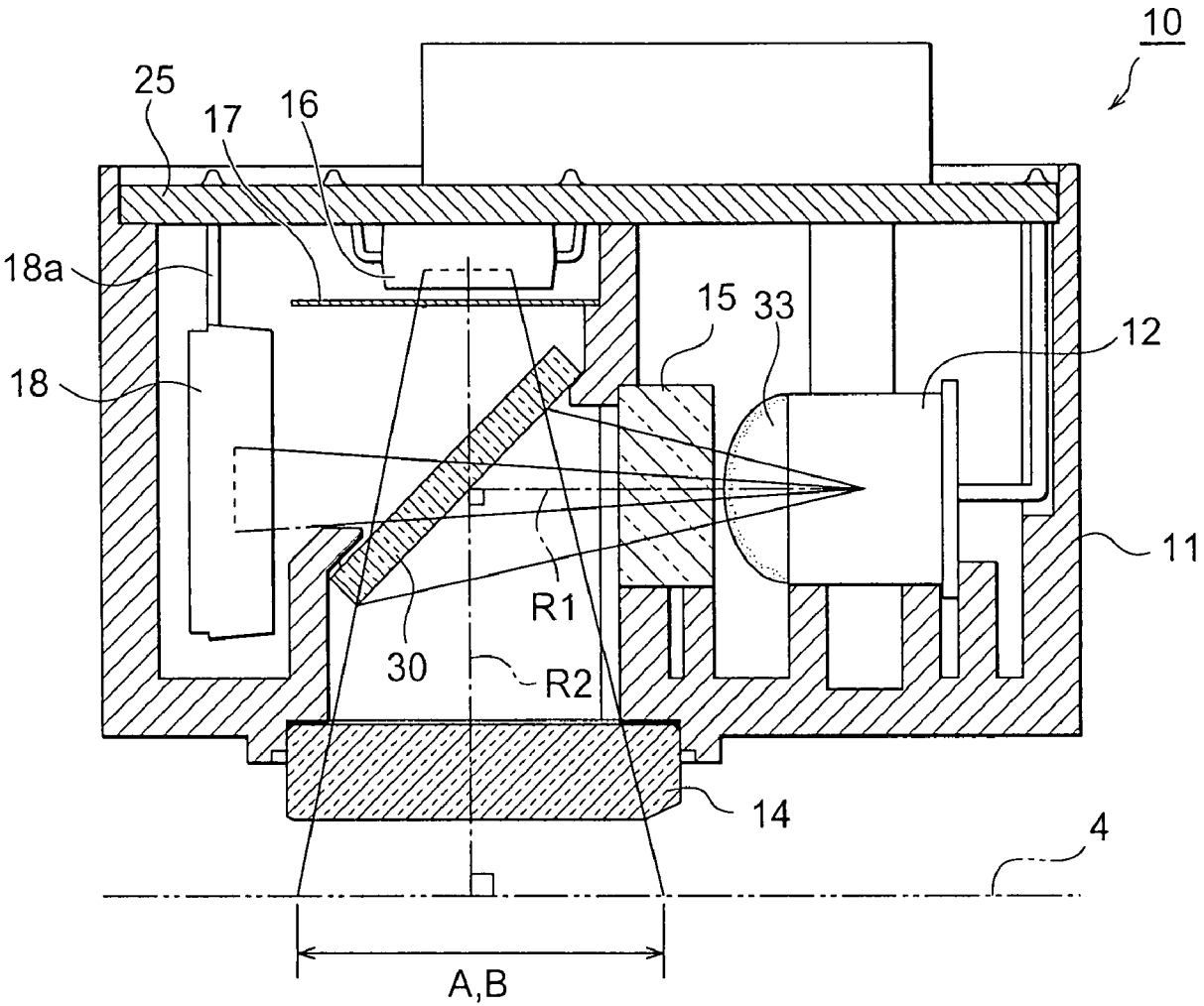
FIG. 3 is a sectional view showing an illumination area and a light-receiving area in the sensor shown in FIG. 2.

For effectively utilizing the ultraviolet ray irradiating the bill 7, it will be preferable if an illumination area A and a light-receiving area B are substantially the same on the conveying path 4 (see FIG. 3). Therefore, the leading end of the ultraviolet LED 12 is provided with a lens part 33. When the light-receiving area B is known beforehand, the lens part 33 is utilized for adjusting the illumination angle of the ultraviolet LED 12, so as to control the light directed to the ultraviolet-reflecting filter 30. Various kinds of lens parts are selected according to characteristics of the ultraviolet LED 12 in order for the light-receiving area B to obtain an optimal brightness. Utilizing such a lens part 33 can adjust the illumination angle of the ultraviolet LED 12 in a simple and reliable manner.

Here, the paper sheet fluorescence sensor 10 is not always utilized at a constant temperature but is susceptible to the ambient temperature of the sensor 10 such as the temperature of the paper sheet tester 1 itself and seasonal temperatures. In particular, the amount of light received by the illumination monitor 18 is heavily influenced by the ambient temperature, since the quantity of light in the ultraviolet LED 12 decreases as the temperature is higher. Therefore, as means for stabilizing the quantity of light received by the illumination monitor 18, the ultraviolet-reflecting filter 30 is constituted as a filter in which a vapor-deposited film of a dielectric substance is formed on a glass substrate with moisture contained between the glass substrate and the vapor-deposited film. Hence, the ultraviolet-reflecting filter 30 exhibits a temperature dependence due to the moisture between the glass substrate and the vapor-deposited film. The ultraviolet-reflecting filter 30 is a multilayer film filter including $SiO_2/TiO_2$ films formed by vacuum deposition such that two kinds of materials are formed alternately.

Figure 5:
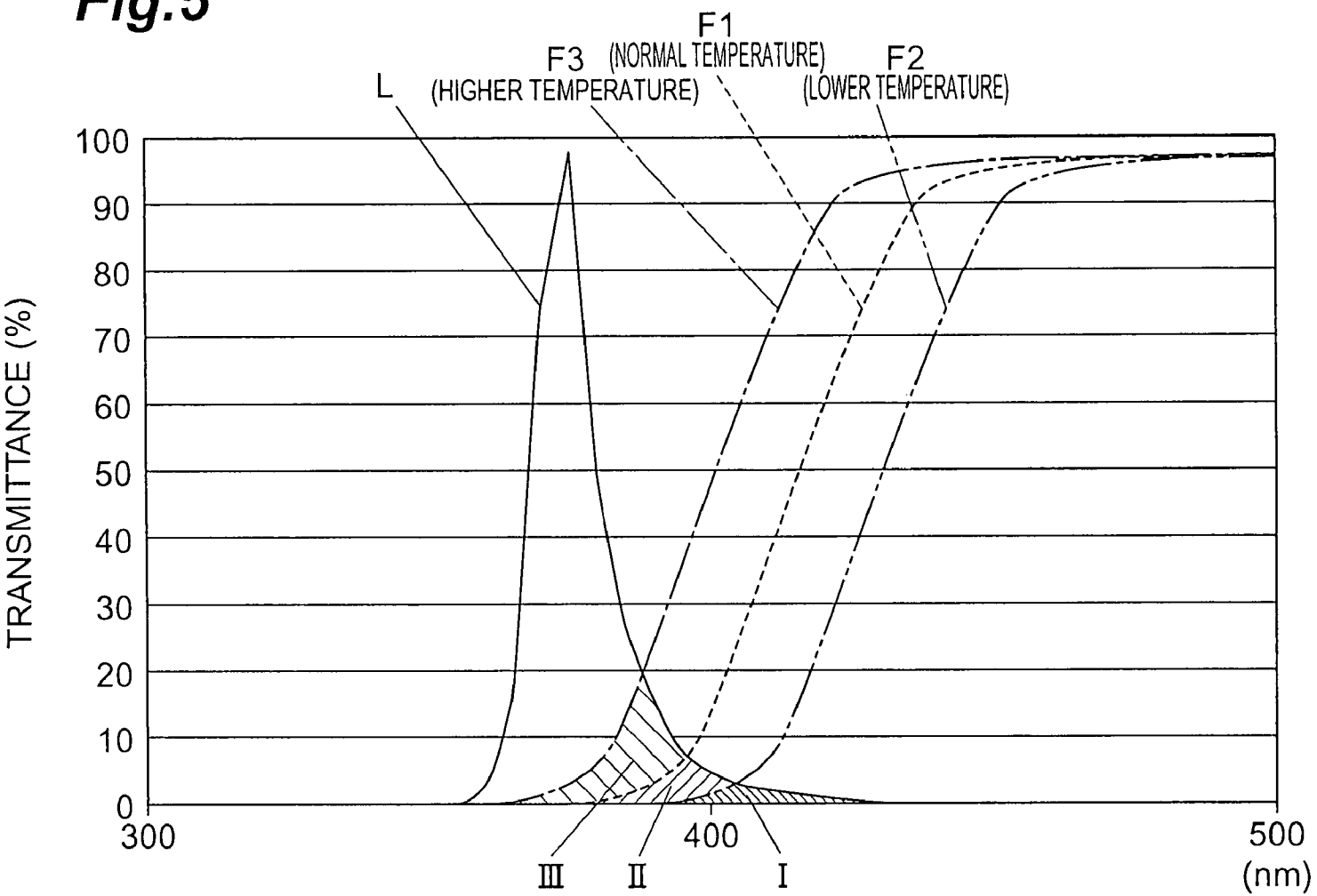
FIG. 5 is a graph showing characteristics of an ultraviolet LED and an ultraviolet-reflecting filter.

As shown in FIG. 5, the ultraviolet-reflecting filter 30 exhibits characteristics indicated by a broken line F1 at a normal temperature (about 25° C.), a dash-double-dot line F2 at a lower temperature (about −10° C.), and a dash-single-dot line F3 at a higher temperature (about 60° C.). Namely, the ultraviolet-reflecting filter 30 has a characteristic of shifting to the shorter wavelength side as temperature is higher. Such a change in the transmission wavelength band is caused by the fact that the moisture in the vapor-deposited film in the filter 30 is thermally expanded so as to change the thickness of the vapor-deposited film and affect the transmittance characteristic.

When the ultraviolet-reflecting filter 30 having such a characteristic is utilized, light indicated by regions of I+II, I, and I+II+III are transmitted therethrough at normal, lower, and higher temperatures, respectively as shown in FIG. 5. Hence, as the ambient temperature rises, the amount of light transmitted through the ultraviolet-reflecting filter 30 increases, thereby compensating for the ultraviolet LED 12 whose quantity of light decreases as the temperature is higher.

Figure 6:
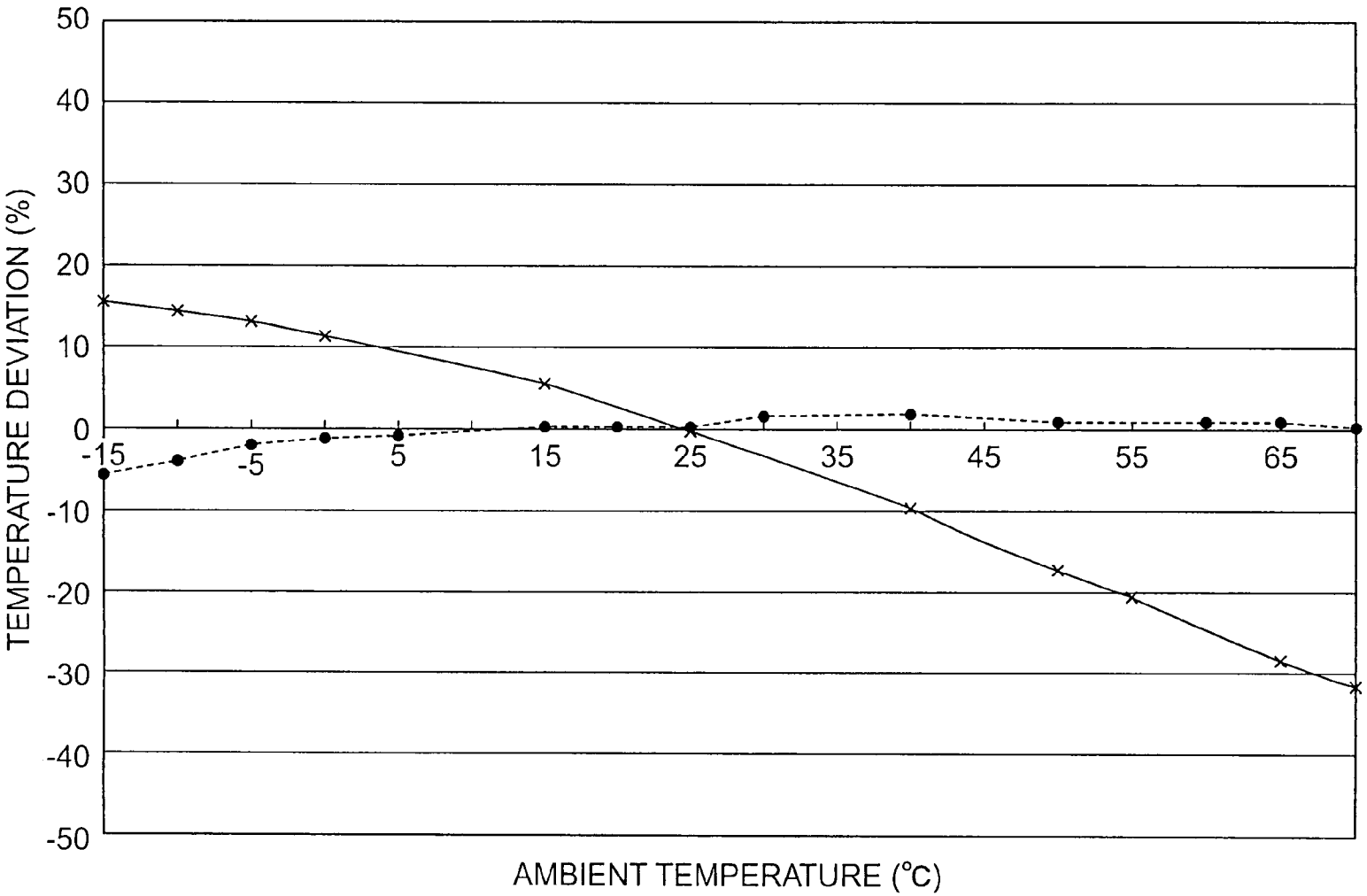
FIG. 6 is a graph showing relationships between ambient temperature and temperature deviation in outputs of an illumination monitor.

An experiment utilizing such an ultraviolet-reflecting filter 30 has yielded such a result that the output from the illumination monitor 18 is less susceptible to the ambient temperature as indicated by the broken line in FIG. 6. By contrast, the solid line in FIG. 6 shows the characteristic of a filter constructed such that no moisture is contained between the glass substrate and the vapor-deposited film. As can be seen from this graph, the output from the illumination monitor 18 is greatly influenced by the ambient temperature. Thus, the experiment has verified that the moisture-containing filter is more effective for restraining the monitor output from fluctuating because of variations in temperature.

Figure 4:
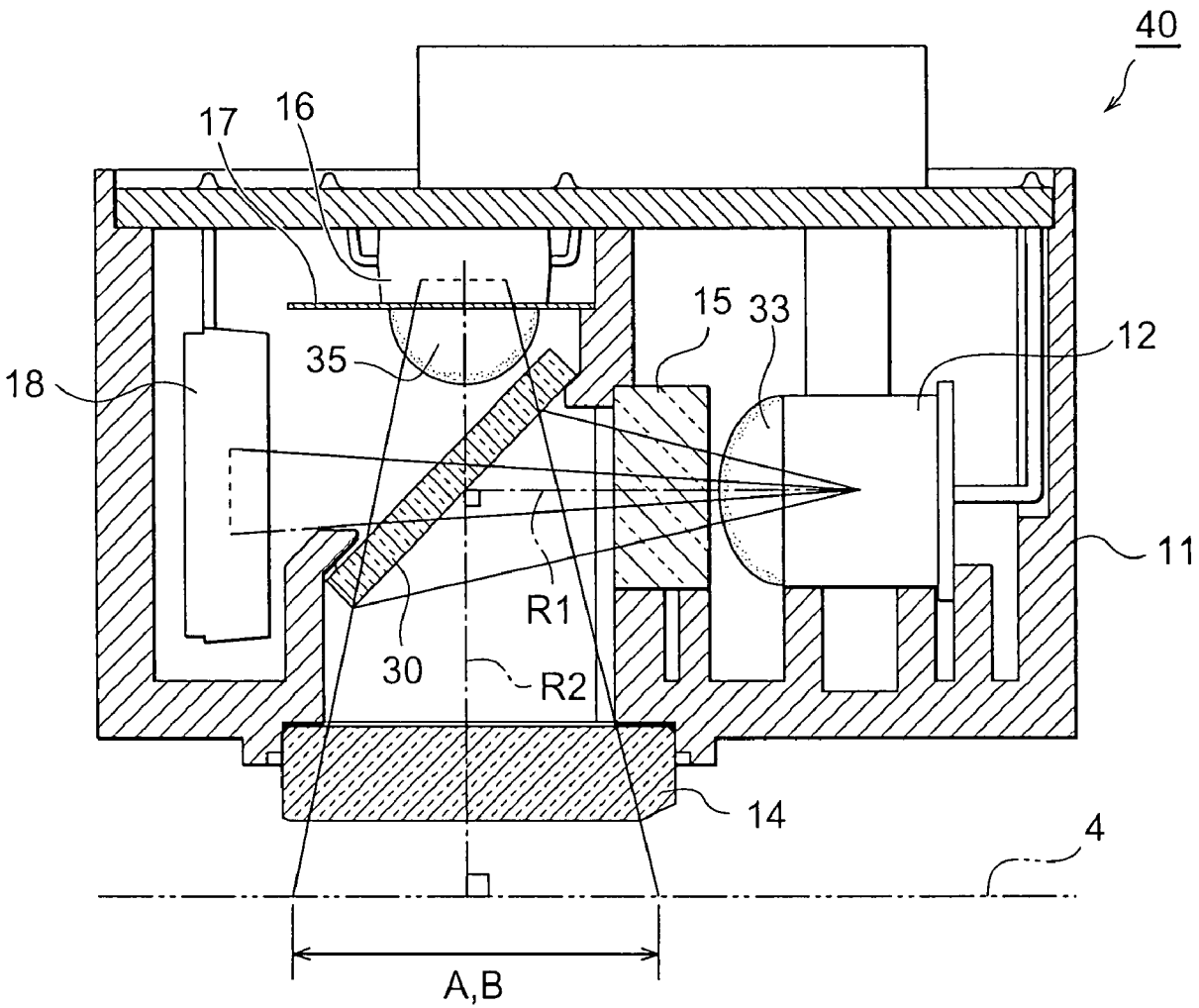
FIG. 4 is a sectional view showing a second embodiment of the paper sheet fluorescence sensor in accordance with the present invention.

The present invention is not restricted to the embodiment mentioned above. For example, as shown in FIG. 4, another paper sheet fluorescence sensor 40 holds an ultraviolet-absorbing filter 17 between the fluorescence-receiving device 16 and a lens part 35 so as to make the illumination area A and the light-receiving area B substantially the same on the conveying path 4 for effectively utilizing the ultraviolet ray irradiating the bill 7. When the illumination area A is known beforehand, the lens part 35 is utilized for adjusting the light-receiving angle of the fluorescence-receiving device 16, so as to regulate the fluorescence transmitted through the ultraviolet-reflecting filter 30 toward the fluorescence-receiving device 16. Various kinds of lens parts 35 are selected according to characteristics of the fluorescence-receiving device 16 so as to attain the optimal light-receiving area B. Utilizing such a lens part 35 can produce the optimal light-receiving area B in a simple and reliable manner.

When a highly directive ultraviolet light source 12 is utilized, the lens part 33 is not necessary. The lens part 33 may be disposed in front of the ultraviolet light source 12 so as to be separated therefrom, whereas the lens part 35 may be disposed in front of the fluorescence-receiving device 16 so as to be separated therefrom.

The paper sheet fluorescence sensor 10 will be summarized as follows:

It will be preferred if an ultraviolet-absorbing filter is disposed between the ultraviolet-reflecting filter and the fluorescence-receiving device. When such a configuration is employed, fluorescence cannot be received accurately if a slight amount of ultraviolet ray is included in the light transmitted through the ultraviolet-reflecting filter. Therefore, the ultraviolet-absorbing filter is disposed in the housing in addition to the ultraviolet-reflecting filter.

Preferably, an illumination monitor, accommodated in the housing, for receiving by way of the ultraviolet-reflecting filter the light emitted from the ultraviolet light source is provided. When such a configuration is employed, paper sheets may not be determined correctly (e.g., in terms of kinds of bills and whether they are authentic or not) unless the light irradiating the paper sheets in the process of conveying is always regulated in a constant state. For eliminating such inconveniences, the illumination monitor is disposed in the housing.

Preferably, the ultraviolet-reflecting filter is a vapor-deposited film optical filter in which moisture is contained between a glass substrate and a vapor-deposited film when forming the vapor-deposited film on the glass substrate. Utilizing such a filter can make a paper sheet fluorescence sensor which is less susceptible to external temperature variations. In the illumination monitor, in particular, the monitor output can be restrained from fluctuating caused by temperature variations.

Preferably, the ultraviolet-reflecting filter is disposed in the housing with such an angle that the light emitted from the ultraviolet light source is bent by 90 degrees, the fluorescence-receiving device is disposed on an optical axis orthogonal to the conveying path, and the illumination monitor is disposed on an extension of an optical axis emitted from the ultraviolet light source. Such a configuration makes it possible to optimize the layout of individual constituents in the housing in the present invention utilizing the ultraviolet-reflecting filter.

Preferably, the ultraviolet light source comprises a lens part for controlling the light directed to the ultraviolet-reflecting filter such that an illumination area substantially the same as a light-receiving area on the conveying path is obtained. Such a configuration is optimal for effectively utilizing the ultraviolet ray irradiating paper sheets when receiving the fluorescence. This can be achieved in a simple and reliable manner by providing the ultraviolet light source with the lens part.

It will also be preferred if the fluorescence-receiving device comprises a lens part for controlling the fluorescence transmitted through the ultraviolet-reflecting filter toward the fluorescence-receiving device such that a light-receiving area substantially the same as an illumination area on the conveying path is obtained. Such a configuration is optimal for effectively utilizing the ultraviolet ray irradiating paper sheets when receiving the fluorescence. This can be achieved in a simple and reliable manner by providing the fluorescence-receiving device with the lens part.

[II]

Figure 7:
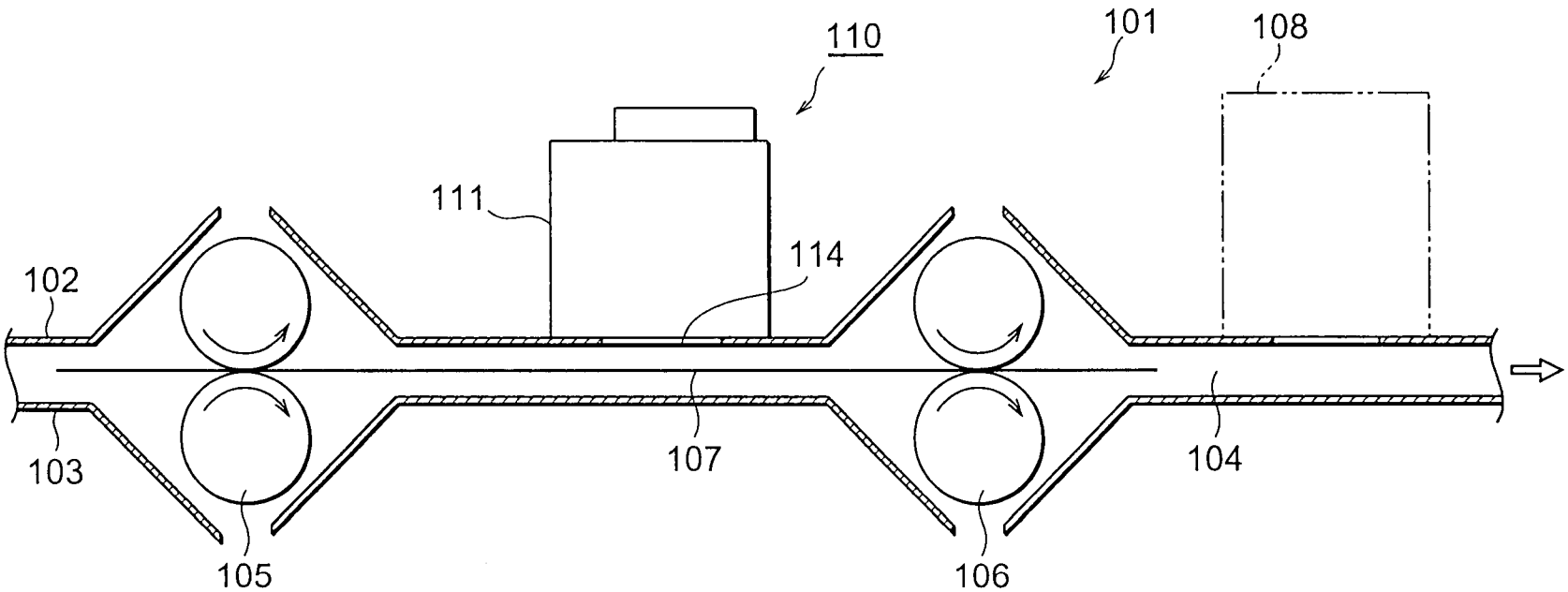
FIG. 7 is a sectional view showing an example of paper sheet tester employing a paper sheet fluorescence sensor.

FIG. 7 is a sectional view showing a paper sheet tester 101. The paper sheet tester 101 determines whether bills, which are an example of paper sheets, are authentic or not. Specifically, the tester discriminates color-copied counterfeit bills and normal bills from each other. Since color-copying paper includes a large amount of fluorescent ingredients, whether bills are authentic or not is determined while taking account of this fact.

The paper sheet tester 101 is provided with a linear conveying path 104 formed so as to be held between upper and lower guide plates 102, 103, whereas conveying rollers 105, 106 are disposed in the conveying path 104, so as to convey a bill 107 reliably to the exit side. In such a conveying path 104, a bill identifying unit 108 for identifying kinds of bills is disposed.

The bill (paper sheet) identifying unit 108 has such a structure that the bill 107 is irradiated with a light source such as LED whereas the reflected light from the bill 107 is captured by a CCD camera. Then, the image captured by the camera and known image data are compared with each other, so as to determine the kind of the bill. With a higher accuracy in color copying, however, it has recently become hard to determine whether the bill 107 is authentic or not according to image recognition alone.

Figure 8:
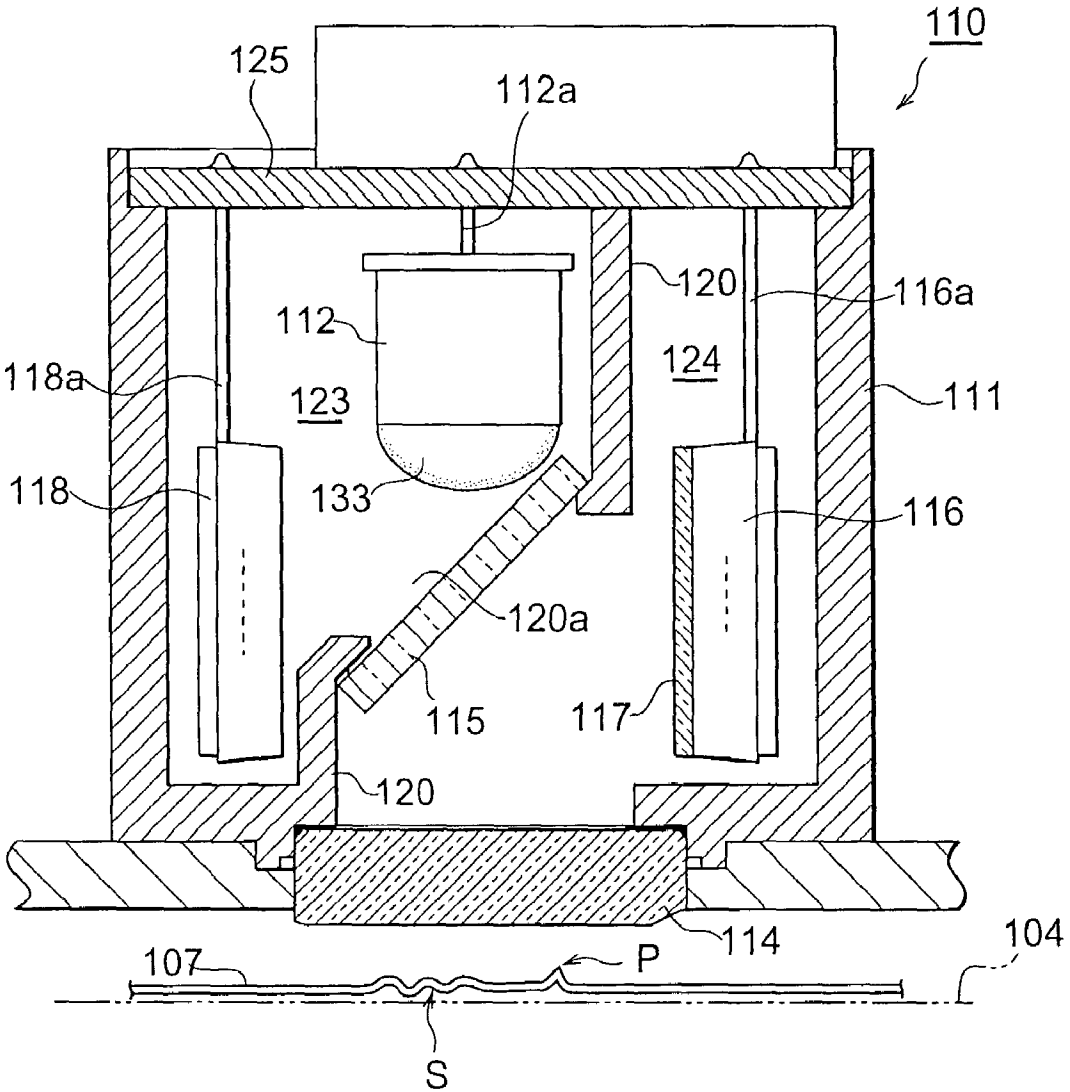
FIG. 8 is a sectional view showing a first example of the paper sheet fluorescence sensor shown in FIG. 7.

Therefore, a paper sheet fluorescence sensor 110 is disposed upstream of the bill identifying unit 108. As shown in FIG. 8, the paper sheet fluorescence sensor 110 has a vertical partition 120 for dividing the inner space of a substantially rectangular parallelepiped housing 111. The partition 120 separates an ultraviolet light source 112 and a fluorescence-reflecting device 116 from each other, and divides the housing 111 into a first chamber 123 and a second chamber 124. In the housing 111, the first chamber 123 formed by the partition 120 accommodates the ultraviolet light source 112 constituted by an ultraviolet LED (light-emitting device). The ultraviolet LED 112 has a lead part 112*a* securely suspended by a short length from a driving circuit board 125 attached to the housing 111.

The ultraviolet light source 112 utilized here is an ultraviolet lamp including a visible light component. The LED is employed as the light source because of such merits that the accommodation space is saved even when the housing 111 is small, the unevenness in luminance is small, and the optical fluctuation over time is little, and thus is optimal for the paper sheet fluorescence sensor 110 intended to be made smaller.

The fluorescence-receiving device (photosensor) 116 for detecting the fluorescence released from the bill 107 is accommodated in the second chamber 124. The light-receiving device 116 has a lead part 16*a* securely suspended from the driving circuit board 125. A dustproof glass sheet 114 is secured to the lower face of the housing 111 with an adhesive or the like, so as to close the second chamber 124. For the dustproof glass sheet 114, a glass material which is easy to transmit ultraviolet rays therethrough is employed.

At an opening 120*a* of the partition 120 disposed between the ultraviolet LED 112 and the dustproof glass sheet 114, a visible-light-reflecting filter 115 is secured to the housing 111 with an adhesive or the like. Employed as the visible-light-reflecting filter 115 is one having such a characteristic as to transmit ultraviolet rays therethrough but reflect visible light. Therefore, when the light emitted from the LED 112 passes through the visible-light-reflecting filter 115, an ultraviolet component (e.g., with a wavelength on the order of 300 to 400 nm) is released into the second chamber 124. Employing such a visible-light-reflecting filter 115 enhances the ultraviolet content and improves the light-receiving accuracy.

When detecting the fluorescence emitted from the bill 107 by utilizing the ultraviolet light source 112 and the fluorescence-receiving device 116, the bill 107 is not always conveyed in a constant state but may be flopped on the conveying path 104. Also, the bill 107 itself may incur a wrinkle S or a bent P. Even in such a state, the output from the fluorescence-receiving device 116 is required to be harder to become uneven.

Therefore, a visible-light-reflecting filter 115 is utilized for orthogonally irradiating the conveying path 104 and appropriately receiving the fluorescence from the bill 107 at the same time. The visible-light-reflecting filter 115 is disposed between the ultraviolet light source 112 and the dustproof glass sheet 114, whereas the ultraviolet light source 112 directs its optical axis R1 (see FIG. 9) orthogonal to the conveying path 104. Further, the visible-light-reflecting filter 115 is secured to the partition 120 in the housing 111 with such an angle (e.g., 45 degrees with respect to the conveying path 104) that the fluorescence emitted from the bill 107 upon irradiation with the ultraviolet ray is reflected by 90 degrees toward the fluorescence-receiving device 116. Namely, the reflecting surface of the visible-light-reflecting filter 115 is positioned on the intersection between the optical axis R2 of the fluorescence-receiving device 116 and the optical axis R1 of the ultraviolet light source 112, so that the optical axis R1 is orthogonal to the conveying path 104.

Therefore, the flopping of the bill 107 on the conveying path 104 can be taken care of as a matter of course and, even if the wrinkle S or bent P occurs in the bill 107, the irradiation of ultraviolet light can be restrained from becoming uneven in the part of wrinkle S or bent P, whereby the fluorescence does not fluctuate. As a result, the fluorescence-receiving accuracy can be raised. When the bill 107 illuminated with the ultraviolet ray includes a fluorescent ingredient, excited fluorescence is released from the bill 107 and is detected by the fluorescence-receiving device 116 along the optical axis R2 after being reflected by the visible-light-reflecting filter 115 along the optical axis R1. For example, when a color-copied counterfeit bill 107 is fed into the conveying path 104, the light-receiving device 116 detects a large amount of fluorescence since color-copying paper includes a large amount of fluorescent ingredients. By contrast, normal bills hardly include fluorescent ingredients, whereby the light-receiving device 116 detects a very small amount of fluorescence. The paper sheet fluorescence sensor 110 utilizing the visible-light-reflecting filter 115 is suitable for a structure for reducing the number of filters, and can be considered a structure which is easily made smaller.

Between the visible-light-reflecting filter 115 and the fluorescence-receiving device 116, an ultraviolet-absorbing filter 117 is mounted to the fluorescence-receiving device 116. Such an ultraviolet-absorbing filter 117 is employed in order to cut off unnecessary ultraviolet components which may be included by a relatively large amount in the light to be made incident on the fluorescence-receiving device 116, thereby improving the light-receiving accuracy.

Unless the quantity of light irradiating the bill 107 in the process of conveying is always regulated in a constant state, the bill 107 may not be inspected correctly (e.g., in terms of the kind of the bill and whether it is authentic or not). Therefore, as a means for regulation, an illumination monitor 118 constituted by a photosensor receives the light reflected by the visible-light-reflecting filter 115. The illumination monitor 118 is accommodated in the first chamber 123 and is disposed on an extension of the optical axis R2 (see FIG. 9), so as to reliably capture the visible light reflected by the visible-light-reflecting filter 115. The illumination monitor 118 has a lead part 118*a* secured to the driving circuit board 125. Therefore, the light emitted from the ultraviolet light source 112 is indirectly received by the illumination monitor 118 by way of the visible-light-reflecting filter 115.

Figure 9:
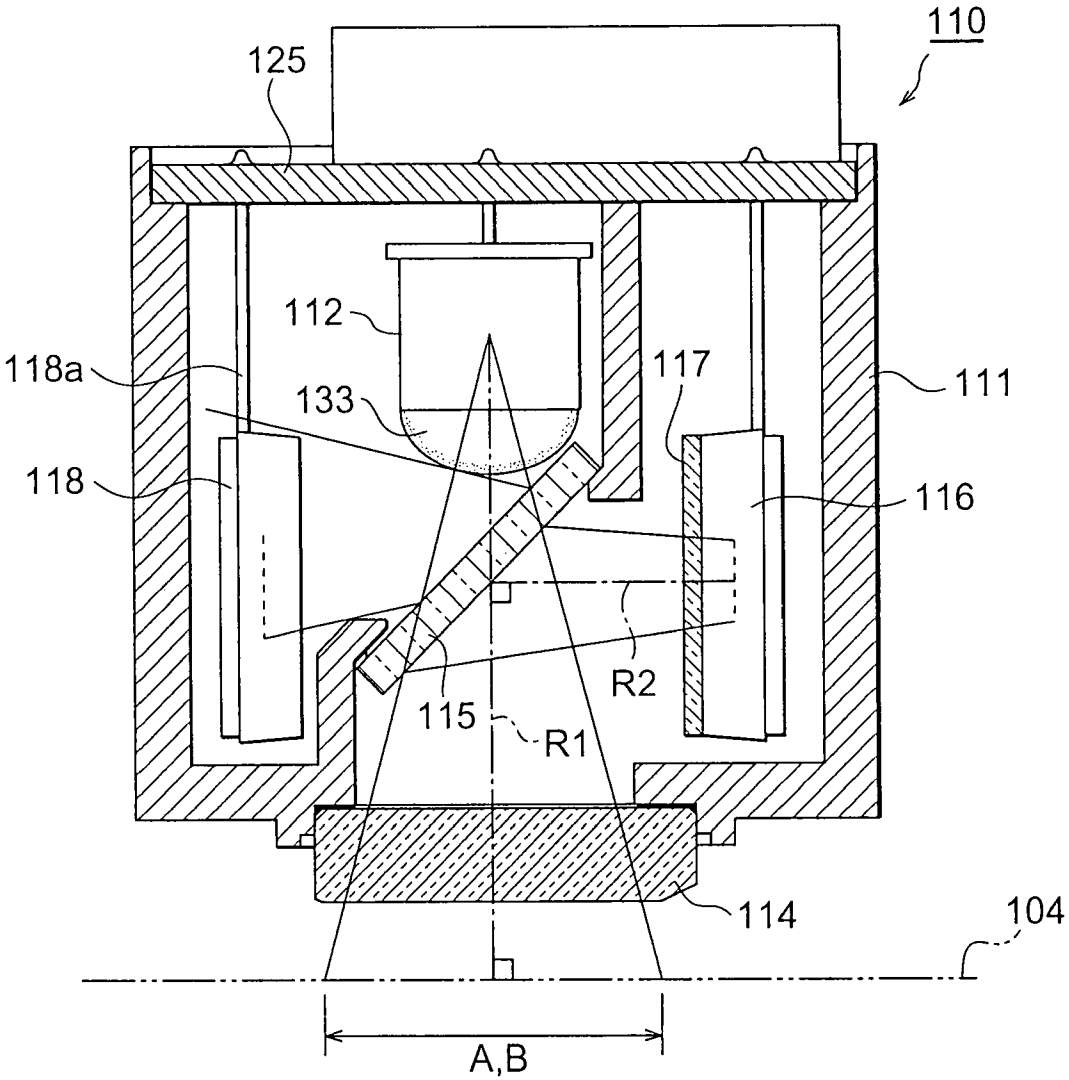
FIG. 9 is a sectional view showing an illumination area and a light-detecting area in the sensor shown in FIG. 8.

For effectively utilizing the ultraviolet ray irradiating the bill 107 in the state shown in FIG. 8, it will be preferable if an illumination area A and a light-receiving area B are substantially the same on the conveying path 104 (see FIG. 9). Therefore, the leading end of the ultraviolet LED 112 is provided with a lens part 133. When the light-receiving area B is known beforehand, the lens part 133 is utilized for adjusting the illumination angle of the ultraviolet LED 112, so as to control the light directed onto the conveying path 104. Various kinds of lens parts are selected according to characteristics of the ultraviolet LED 112 in order for the light-receiving area B to obtain an optimal brightness. Utilizing such a lens part 133 can adjust the illumination angle of the ultraviolet LED 112 in a simple and reliable manner.

Figure 10:
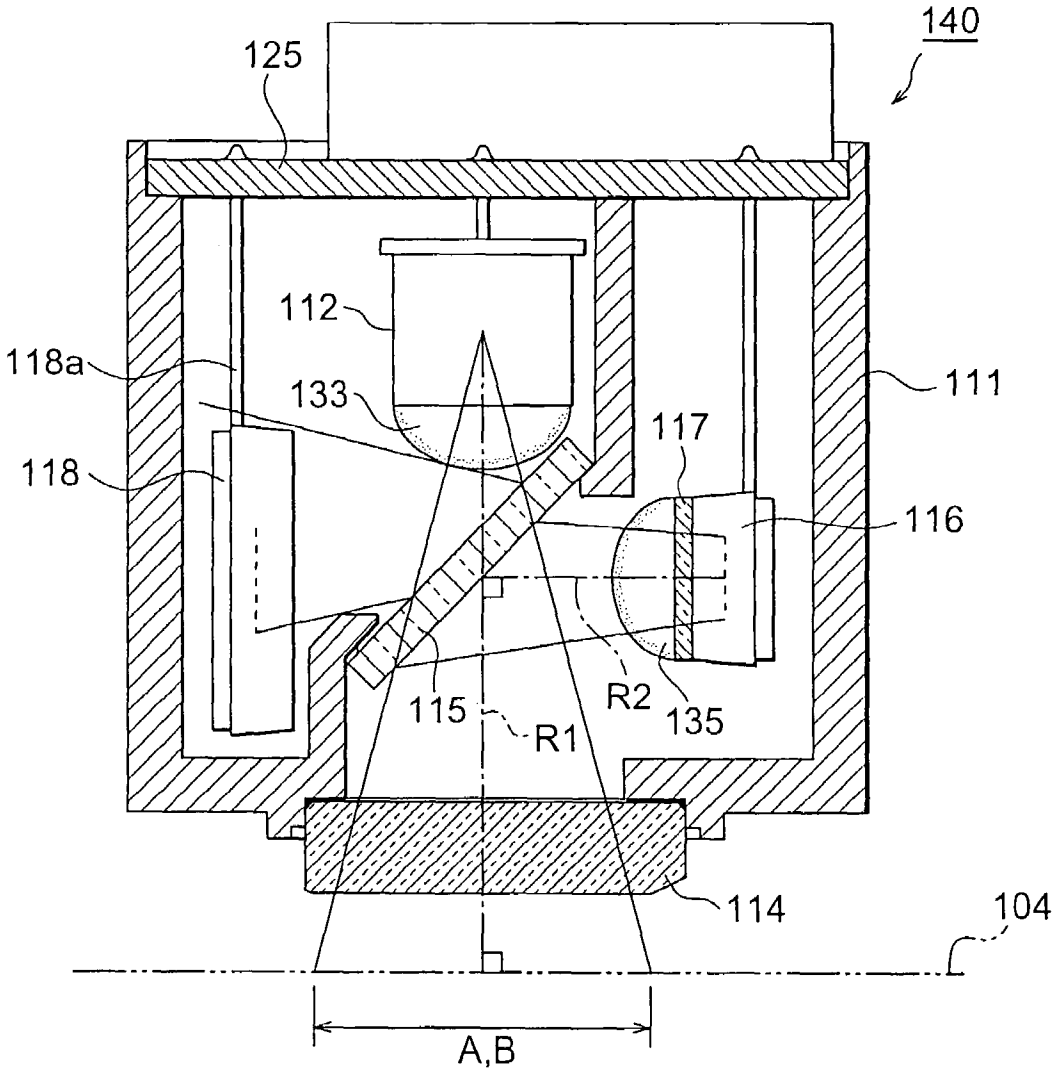
FIG. 10 is a sectional view showing a second example of the paper sheet fluorescence sensor shown in FIG. 7.

For example, as shown in FIG. 10, another paper sheet fluorescence sensor 140 holds an ultraviolet-absorbing filter 117 between the fluorescence-receiving device 116 and a lens part 135 so as to make the illumination area A and the light-receiving area B substantially the same on the conveying path 104 for effectively utilizing the ultraviolet ray irradiating the bill 107 (see FIG. 8). When the illumination area A is known beforehand, the lens part 135 is utilized for adjusting the light-receiving angle of the fluorescence-receiving device 116, so as to regulate the fluorescence directed toward the light-receiving part of the fluorescence-receiving device 116. Various kinds of lens parts 135 are selected according to characteristics of the fluorescence-receiving device 116 so as to attain an optimal light-receiving area B. Utilizing such a lens part 135 can produce the optimal light-receiving area B in a simple and reliable manner.

When a highly directive ultraviolet light source 112 is utilized, the lens part 133 is not necessary. The lens part 133 may be disposed in front of the ultraviolet light source 112 so as to be separated therefrom, whereas the lens part 135 may be disposed in front of the fluorescence-receiving device 116 so as to be separated therefrom.

The paper sheet fluorescence sensor 110 will be summarized as follows:

A paper sheet fluorescence sensor for accurately receiving fluorescence generated by a paper sheet while being less likely to be influenced by a state of the paper sheet; the paper sheet fluorescence sensor irradiating the paper sheet with light while conveying the paper sheet, and detecting the fluorescence emitted from the paper sheet; the sensor comprises:

an ultraviolet light source accommodated in a housing;

a visible-light-reflecting filter, accommodated in the housing, for transmitting therethrough an ultraviolet ray emitted from the ultraviolet light source and reflecting visible light so as to irradiate a conveying path of the paper sheet orthogonally with the ultraviolet ray;

a fluorescence-receiving device, accommodated in the housing, for receiving the fluorescence emitted from the paper sheet upon irradiation with the ultraviolet ray and then reflected by the visible-light-reflecting filter; and an ultraviolet-absorbing filter disposed between the visible-light-reflecting filter and the fluorescence-receiving device.

This paper sheet fluorescence sensor is based on the presupposition that the paper sheet is irradiated with the ultraviolet ray, and the fluorescence emitted from the paper sheet is received by the fluorescence-receiving device so as to determine the kind of the paper sheet, whether the paper sheet is authentic or not, etc. On the conveying path, the paper sheet is not always conveyed in a constant state but may be flopped. Also, the paper sheet itself may be wrinkled or bent. The output from the fluorescence-receiving device is required to be hard to become uneven in any of such states. Hence, for orthogonally irradiating the conveying path with the ultraviolet ray and appropriately receiving the fluorescence from the paper sheet at the same time, a visible-light-reflecting filter is utilized. In the light emitted from the ultraviolet light source, the visible-light-reflecting filter transmits the ultraviolet ray therethrough and reflects the visible light, thereby producing ultraviolet light having an optical axis orthogonal to the conveying path of the paper sheet. The fluorescence emitted from the paper sheet by the light transmitted through the visible-light-reflecting filter is reflected by the visible-light-reflecting filter and then is received by the fluorescence-receiving device. Further, the ultraviolet-absorbing filter disposed between the visible-light-reflecting filter and the fluorescence-receiving device cuts off the ultraviolet component to be made incident on the fluorescence-receiving device, thereby improving the light-receiving accuracy. The paper sheet fluorescence sensor utilizing the visible-light-reflecting filter is suitable for a structure for reducing the number of filters, and can be considered a structure which is easily made smaller.

Preferably, an illumination monitor, accommodated in the housing, for receiving the light emitted from the ultraviolet light source and reflected by the visible-light-reflecting filter is provided. When such a configuration is employed, paper sheets may not be determined correctly (e.g., in terms of kinds of bills and whether they are authentic or not) unless the light irradiating the paper sheets in the process of conveying is always regulated in a constant state. For eliminating such inconveniences, the illumination monitor is disposed in the housing.

Preferably, the visible-light-reflecting filter is disposed within the housing with such an angle that the fluorescence emitted from the paper sheet is bent by 90 degrees toward the fluorescence-receiving device, the ultraviolet light source is disposed on an optical axis orthogonal to the conveying path, and the illumination monitor is disposed on an extension of an optical axis of the fluorescence-receiving device. Such a configuration makes it possible to optimize the layout of individual constituents in the housing.

Preferably, the ultraviolet light source comprises a lens part for controlling the light directed to the visible-light-reflecting filter such that an illumination area substantially the same as a light-receiving area on the conveying path is obtained. Such a configuration is optimal for effectively utilizing the ultraviolet ray irradiating paper sheets when receiving the fluorescence. This can be achieved in a simple and reliable manner by providing the ultraviolet light source with the lens part.

It will also be preferred if the fluorescence-receiving device comprises a lens part for controlling the light reflected by the visible-light-reflecting filter toward the fluorescence-receiving device such that a light-receiving area substantially the same as an illumination area on the conveying path is obtained. Such a configuration is optimal for effectively utilizing the ultraviolet ray irradiating paper sheets when receiving the fluorescence. This can be achieved in a simple and reliable manner by providing the fluorescence-receiving device with the lens part.

[III]

Figure 11:
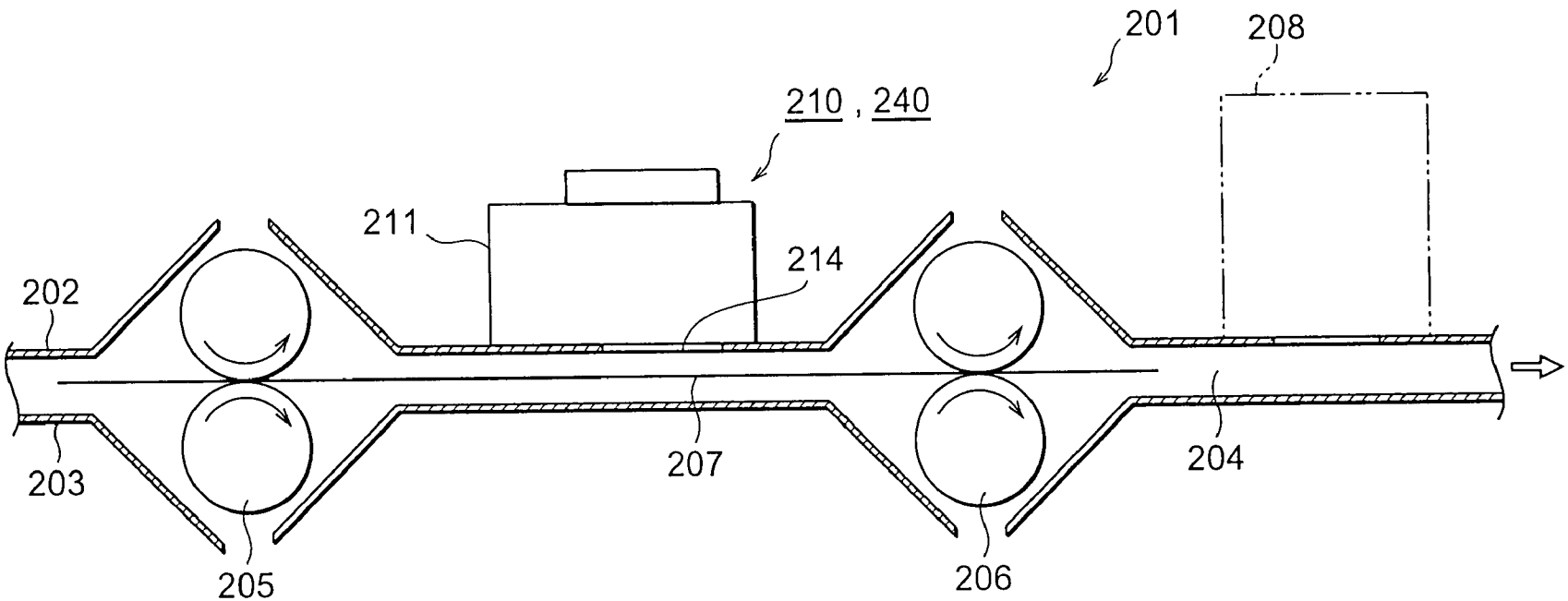
FIG. 11 is a sectional view showing an example of paper sheet tester employing a paper sheet fluorescence sensor.

FIG. 11 is a sectional view showing a paper sheet tester 201. The paper sheet tester 201 determines whether bills, which are an example of paper sheets, are authentic or not. Specifically, the tester discriminates color-copied counterfeit bills and normal bills from each other. Since color-copying paper includes a large amount of fluorescent ingredients, whether bills are authentic or not is determined while taking account of this fact.

The paper sheet tester 201 is provided with a linear conveying path 204 formed so as to be held between upper and lower guide plates 202, 203, whereas conveying rollers 205, 206 are disposed in the conveying path 204, so as to convey a bill 207 reliably to the exit side. In such a conveying path 204, a bill identifying unit 208 for identifying kinds of bills is disposed.

The bill (paper sheet) identifying unit 208 has such a structure that the bill 207 is irradiated with a light source such as LED whereas the reflected light from the bill 207 is captured by a CCD camera. Then, the image captured by the camera and known image data are compared with each other, so as to determine the kind of the bill. With a higher accuracy in color copying, however, it has recently become hard to determine whether the bill 207 is authentic or not according to image recognition alone.

Figure 12:
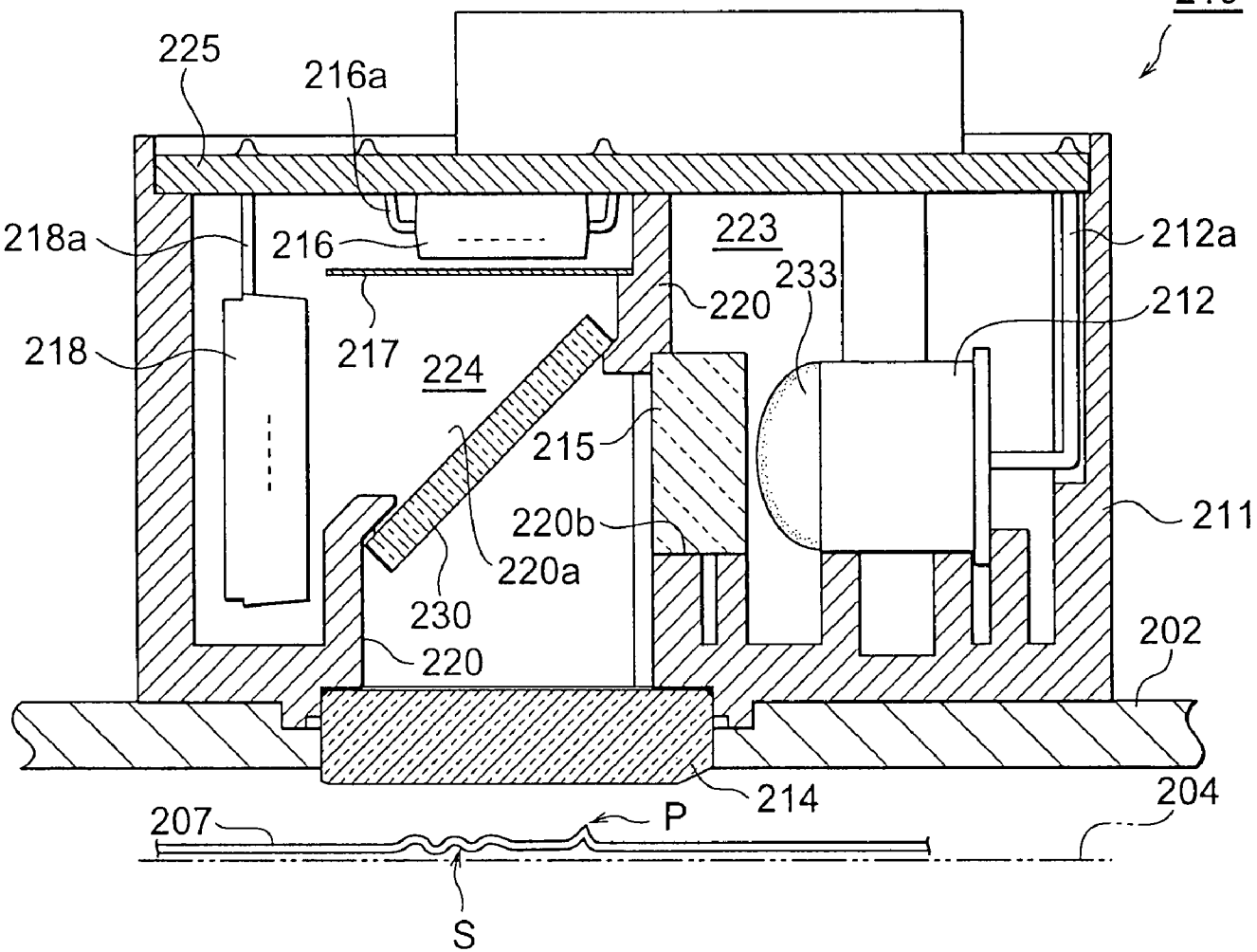
FIG. 12 is a sectional view showing a first example of the paper sheet fluorescence sensor shown in FIG. 11.

Therefore, a paper sheet fluorescence sensor 210 is disposed upstream of the bill identifying unit 208. As shown in FIG. 12, the paper sheet fluorescence sensor 210 has a vertical partition 220 for dividing the inner space of a horizontally-elongated substantially rectangular parallelepiped housing 211. The partition 220 separates an ultraviolet light source 212 and a fluorescence-receiving device 216 from each other, and divides the housing 211 into a first chamber 223 and a second chamber 224. In the housing 211, the first chamber 223 formed by the partition 220 accommodates the ultraviolet light source 212 constituted by an ultraviolet LED (light-emitting device). The ultraviolet LED 212 is secured to a driving circuit board 225 attached to the housing 211 with an L-shaped lead part 212*a*. The ultraviolet light source 212 utilized here is an ultraviolet lamp including a visible light component. The LED is employed as the light source because of such merits that the accommodation space is saved even when the housing 211 is small, the unevenness in luminance is small, and the optical fluctuation over time is little, and thus is optimal for the paper sheet fluorescence sensor 210 intended to be made smaller.

The light-receiving device (photosensor) 216 for detecting the fluorescence released from the bill 207 is accommodated in the second chamber 224. The light-receiving device 216 has a lead part 216*a* secured to the driving circuit board 225. A dustproof glass sheet 214 is secured to the lower face of the housing 211 with an adhesive or the like, so as to close the first chamber 223. For the dustproof glass sheet 214, a glass material which is easy to transmit ultraviolet rays therethrough is employed. An ultraviolet-transmitting filter 215 disposed in front of the ultraviolet light source 212 is secured with an adhesive or the like to the wall face of an opening 220*b* formed in the first chamber 223. Therefore, when the light emitted from the ultraviolet LED 212 passes through the ultraviolet-transmitting filter 215, an ultraviolet component (e.g., with a wavelength on the order of 300 to 400 nm) is released from the ultraviolet-transmitting filter 215. Employing such an ultraviolet-transmitting filter 215 enhances the ultraviolet content and improves the light-receiving accuracy.

When detecting the fluorescence emitted from the bill 207 by utilizing the ultraviolet light source 212 and the light-receiving device 216, the bill 207 is not always conveyed in a constant state but may be flopped on the conveying path 204. Also, the bill 207 itself may incur a wrinkle S or a bent P. Even in such a state, the output from the light-receiving device 216 is required to be harder to become uneven.

Therefore, a half mirror 230, which is an example of light-transmitting/reflecting mirror, is utilized for orthogonally irradiating the conveying path 204 and appropriately receiving the fluorescence from the bill 207 at the same time. The half mirror 230 is secured to the partition 220 so as to close an opening 220*a* of the partition 220 with such an angle (e.g., 45 degrees with respect to the conveying path 204) that the ultraviolet ray emitted from the ultraviolet light source 212 having an optical axis R1 (see FIG. 13) parallel to the conveying path 204 is bent by 90 degrees. As a consequence, the ultraviolet ray illuminates the bill 207 with an optical axis R2 (see FIG. 13) orthogonal to the conveying path 204. The light-detecting device 216 is disposed on an extension of the optical axis R2 orthogonal to the conveying path 204 and receives the light transmitted through the half mirror 230.

Between the half mirror 230 and the light-receiving device 216, an ultraviolet cut filter 217 is secured to the inside of the housing 211 with an adhesive or the like in front of the light-receiving device 216. Such an ultraviolet cut filter 217 is employed, since fluorescence cannot accurately be received by the light-receiving device 216 if an ultraviolet component is included in the light transmitted through the half mirror 230.

Therefore, when the conveying path 204 is orthogonally irradiated with the ultraviolet light, the flopping of the bill 207 on the conveying path 204 can be taken care of as a matter of course and, even if the wrinkle S or bent P occurs in the bill 207, the irradiation of ultraviolet light can be restrained from becoming uneven in the part of wrinkle S or bent P, whereby the unevenness in fluorescence is reduced. As a result, the fluorescence-receiving accuracy can be raised. When the bill 207 illuminated with the ultraviolet ray includes a fluorescence-generating ingredient, excited fluorescence is released from the bill 207 and is appropriately detected by the light-receiving device 216 after passing through the half mirror 230 along the optical axis R2.

For example, when a color-copied counterfeit bill 207 is fed into the conveying path 204, the light-receiving device 216 detects a large amount of fluorescence since color-copying paper includes a large amount of fluorescence-generating ingredients. By contrast, normal bills hardly include fluorescence-generating ingredients, whereby the light-receiving device 216 detects a very small amount of fluorescence. Utilizing such a half mirror 230 can make the sensor itself inexpensive, thereby cutting down the manufacturing cost. Utilizing the half mirror (light-transmitting/reflecting mirror) 230 in the paper sheet fluorescence sensor 210 is also advantageous in that the degree of freedom increases in arrangements of constituents, e.g., the ultraviolet light source 212 and the light-receiving device 216, in the housing 211.

Unless the quantity of light irradiating the bill 207 in the process of conveying is always regulated in a constant state, the bill 207 may not be inspected correctly (e.g., in terms of the kind of the bill and whether it is authentic or not).

Therefore, as a means for regulation, an illumination monitor 218 constituted by a photosensor receives the light transmitted through the half mirror 230. The illumination monitor 218 is accommodated in the second chamber 224 and is disposed on an extension of the optical axis R1 (see FIG. 13). The illumination monitor 218 has a lead part 218*a* secured to the driving circuit board 225. Therefore, the light emitted from the ultraviolet light source 212 is indirectly received by the illumination monitor 218 by way of the half mirror 230.

Figure 13:
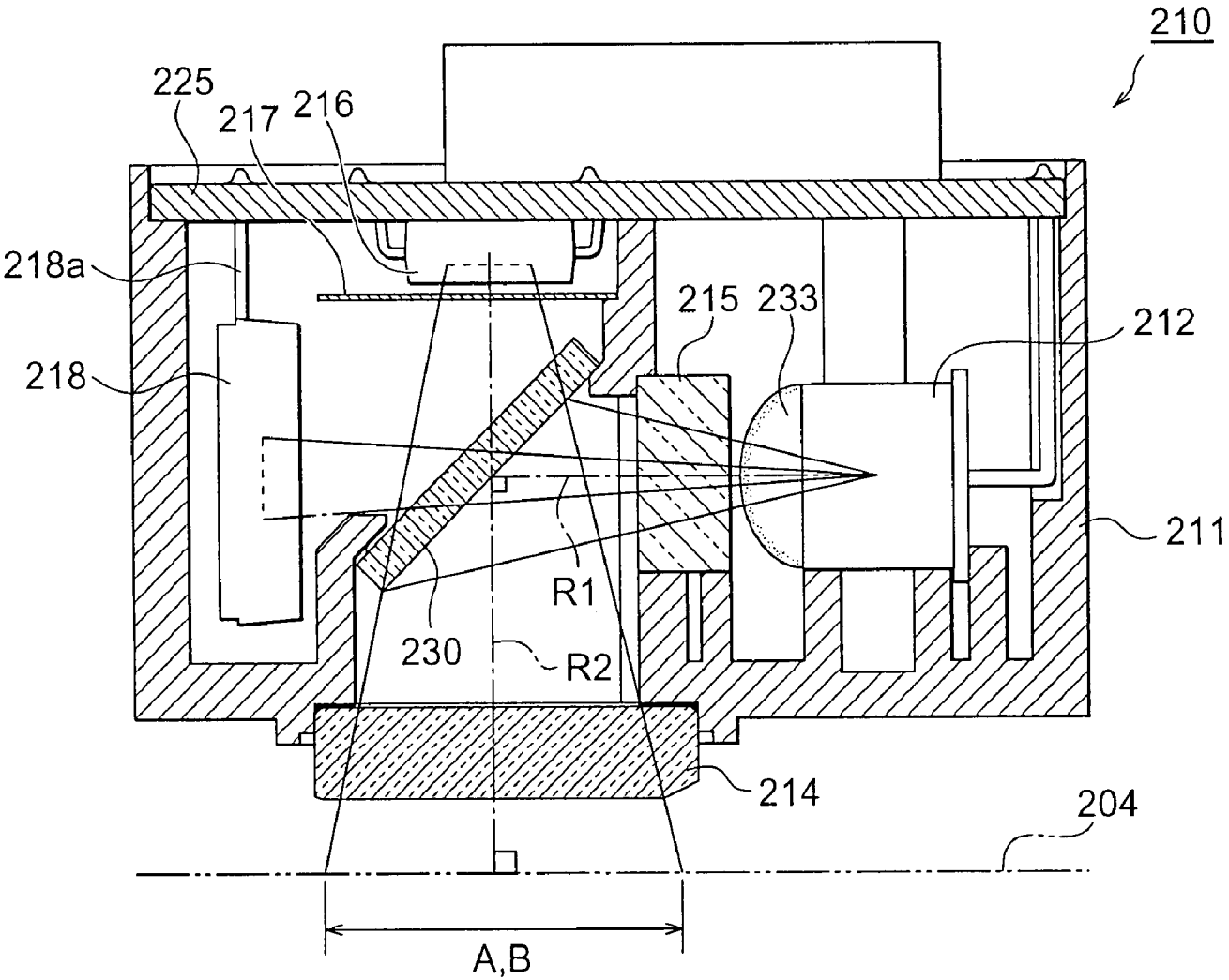
FIG. 13 is a sectional view showing an illumination area and a light-detecting area in the sensor shown in FIG. 12.

For effectively utilizing the ultraviolet ray irradiating the bill 207, it will be preferable if an illumination area A and a light-receiving area B are substantially the same on the conveying path 204 (see FIG. 13). Therefore, the leading end of the ultraviolet LED 212 is provided with a lens part 233. When the light-receiving area B is known beforehand, the lens part 233 is utilized for adjusting the illumination angle of the ultraviolet LED 212, so as to control the light directed to the half mirror 230. Various kinds of lens parts are selected according to characteristics of the ultraviolet LED 212 in order for the light-receiving area B to obtain an optimal brightness. Utilizing such a lens part 233 can adjust the illumination angle of the ultraviolet LED 212.

Figure 14:
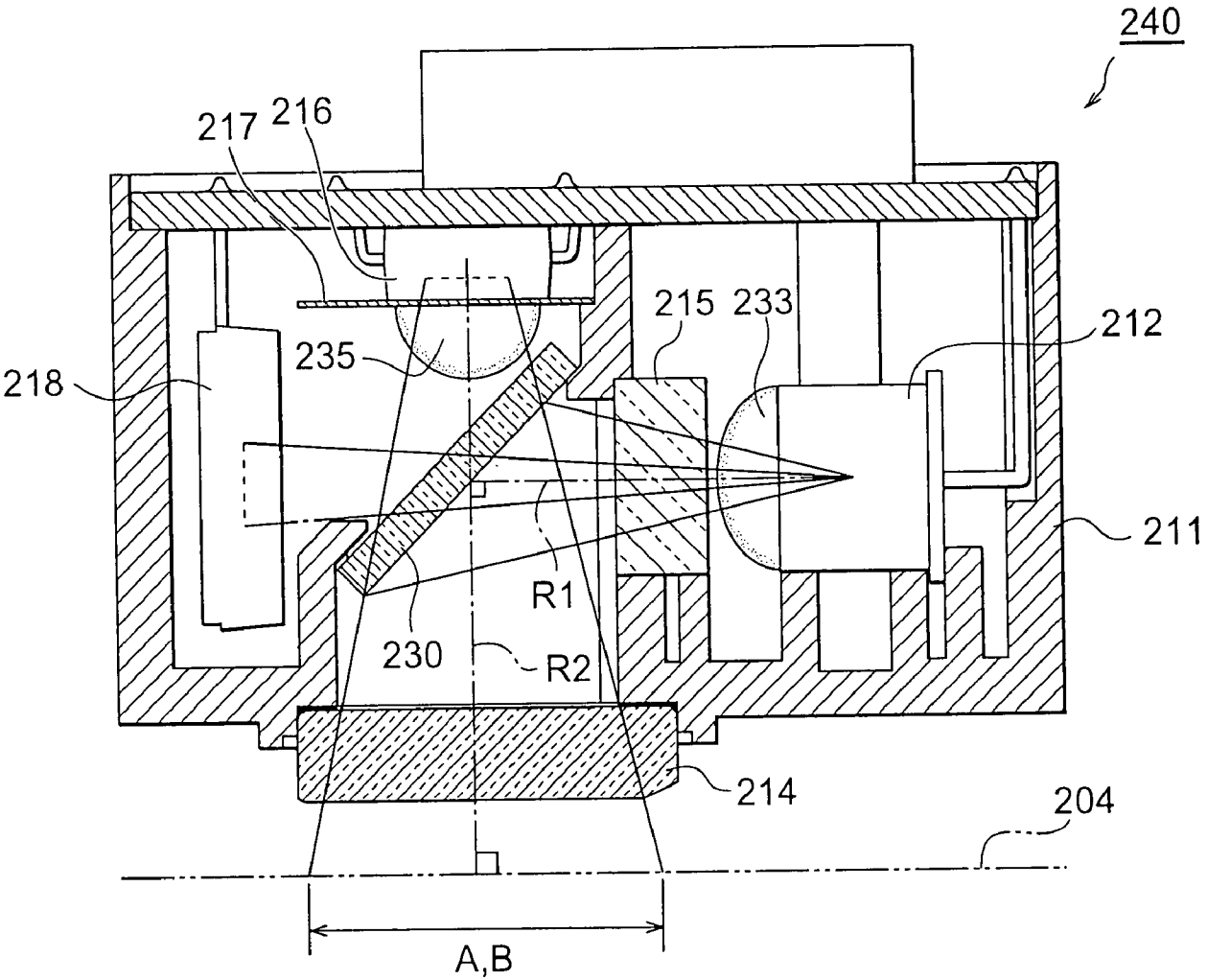
FIG. 14 is a sectional view showing a modified example of the paper sheet fluorescence sensor shown in FIG. 12.

As shown in FIG. 14, another paper sheet fluorescence sensor 240 may hold an ultraviolet cut filter 217 between the light-receiving device 216 and a lens part 235 so as to make the illumination area A and the light-receiving area B substantially the same on the conveying path 204 for effectively utilizing the ultraviolet ray irradiating the bill 207. When the illumination area A is known beforehand, the lens part 235 is utilized for adjusting the light-receiving angle of the light-receiving device 216, so as to regulate the fluorescence transmitted through the half mirror 230 toward the light-receiving device 216. Various kinds of lens parts 235 are selected according to characteristics of the light-receiving device 216 so as to attain the optimal light-receiving area B. Utilizing such a lens part 235 can produce the optimal light-receiving area B.

When a highly directive ultraviolet light source 212 is utilized, the lens part 233 is not necessary. The lens part 233 may be disposed in front of the ultraviolet light source 212 so as to be separated therefrom, whereas the lens part 235 may be disposed in front of the light-receiving device 216 so as to be separated therefrom. Though a half mirror whose ratio between light transmission and light reflection is 5/5 is explained as an example of the light-transmitting/reflecting mirror 230, various ratios are selectable in relation to the luminance of the ultraviolet light source 212 and the sensitivity of the light-receiving device 216 as a matter of course.

Figure 15:
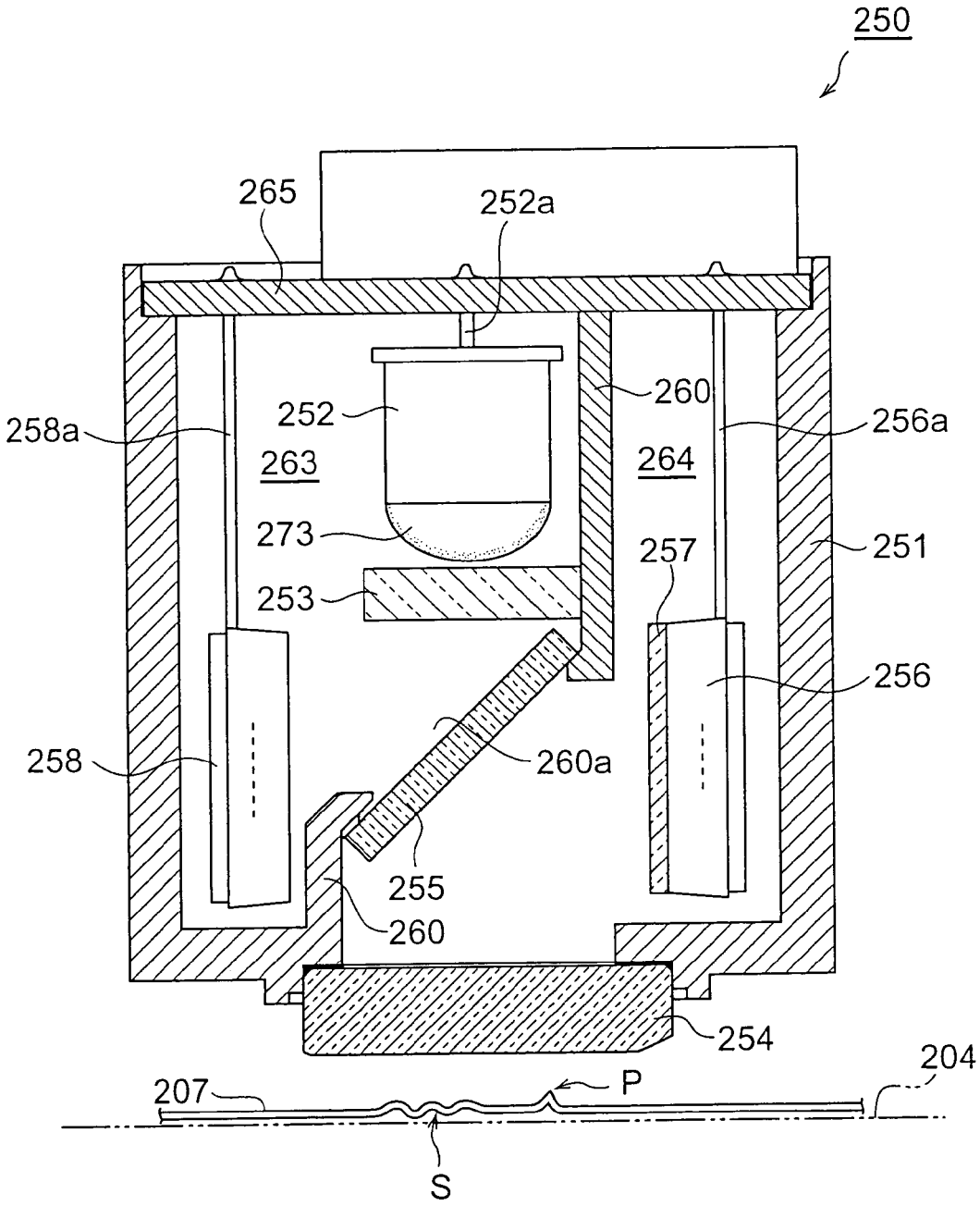
FIG. 15 is a sectional view showing a second example of the paper sheet fluorescence sensor shown in FIG. 11.

A paper sheet fluorescence sensor 250 shown in FIG. 15 comprises a housing 251 having a vertically-elongated substantially rectangular parallelepiped form, and a vertical partition 260 dividing the inner space of the housing 251. The partition 260 separates an ultraviolet light source 252 and a light-receiving device 256 from each other, and divides the inside of the housing 251 into a first chamber 263 and a second chamber 264. In the housing 251, the first chamber 263 formed by the partition 260 accommodates the ultraviolet light source 252 constituted by an ultraviolet LED (light-emitting device). The ultraviolet LED 252 has a lead part 252*a* securely suspended from a driving circuit board 265 attached to the housing 251.

The ultraviolet light source 252 utilized here is an ultraviolet lamp including a visible light component. The LED is employed as the light source because of such merits that the accommodation space is saved even when the housing 251 is small, the unevenness in luminance is small, and the optical fluctuation over time is little, and thus is optimal for the paper sheet fluorescence sensor 250 intended to be made smaller.

The light-receiving device (photosensor) 256 for detecting the fluorescence released from the bill 207 is accommodated in the second chamber 264. The light-receiving device 256 has a lead part 256*a* securely suspended from the driving circuit board 265. A dustproof glass sheet 254 is secured to the lower face of the housing 251 with an adhesive or the like, so as to close the second chamber 264. For the dustproof glass sheet 254, a glass material which is easy to transmit ultraviolet rays therethrough is employed. An ultraviolet-transmitting filter 253 disposed in front of the ultraviolet-light source 252 is secured to the partition 260 with an adhesive or the like. Therefore, when the light emitted from the ultraviolet LED 252 is transmitted through the ultraviolet-transmitting filter 253, an ultraviolet component (e.g., with a wavelength on the order of 300 to 400 nm) is released from the ultraviolet-transmitting filter 253. Employing such an ultraviolet-transmitting filter 253 enhances the ultraviolet content and improves the light-receiving accuracy.

Also, a half mirror 255, which is an example of light-transmitting/reflecting mirror, is secured to the partition 260 disposed between the ultraviolet LED 252 and the dustproof glass sheet 254 with an adhesive or the like so as to close an opening 260*a* of the partition 260. In the half mirror 255, the ratio between light transmission and light reflection is 5/5. Therefore, light (e.g., with a wavelength on the order of 300 to 400 nm) emitted from the ultraviolet-transmitting filter 253 is simply transmitted through the half mirror 255 and released toward the dustproof glass sheet 254.

When detecting the fluorescence emitted from the bill 207 by utilizing the ultraviolet light source 252 and the light-receiving device 256, the bill 207 is not always conveyed in a constant state but may be flopped on the conveying path 204. Also, the bill 207 itself may incur a wrinkle S or a bent P. Even in such a state, the output from the light-receiving device 256 is required to be harder to become uneven.

Therefore, the above-mentioned half mirror 255 is utilized for orthogonally irradiating the conveying path 204 with the ultraviolet ray and appropriately receiving the fluorescence from the bill 207 at the same time. The half mirror 255 is disposed between the ultraviolet light source 252 and the dustproof glass sheet 254, whereas the ultraviolet light source 252 is directed such that its optical axis R1 (see FIG. 16) is orthogonal to the conveying path 204. Further, the half mirror 255 is secured to the partition 260 of the housing 251 with such an angle (e.g., 45 degrees with respect to the conveying path 204) that the fluorescence emitted from the bill 207 upon irradiation with the ultraviolet ray is bent by 90 degrees toward the light-receiving device 256. Namely, the reflecting surface of the half mirror 255 is positioned on the intersection between the optical axis R2 of the light-receiving device 256 and the optical axis R1 of the ultraviolet light source 252, whereas the optical axis R1 is orthogonal to the conveying path 204.

Between the half mirror 255 and the light-receiving device 256, an ultraviolet cut filter 257 is mounted to the light-receiving device 256. Such an ultraviolet cut filter 257 is employed in order to cut off unnecessary ultraviolet components and improve the light-receiving accuracy, since the light to be made incident on the light-receiving device 256 may contain a relatively large amount of ultraviolet components.

Therefore, when the conveying path 204 is orthogonally irradiated with the ultraviolet light, the flopping of the bill 207 on the conveying path 204 can be taken care of as a matter of course and, even if the wrinkle S or bent P occurs in the bill 207, the irradiation of ultraviolet light can be restrained from becoming uneven in the part of wrinkle S or bent P, whereby the fluorescence does not fluctuate. As a result, the fluorescence-receiving accuracy can be raised. When the bill 207 illuminated with the ultraviolet ray includes a fluorescence-generating ingredient, excited fluorescence is released from the bill 207 and is appropriately detected by the light-receiving device 256 along the optical axis R2 after being reflected by the half mirror 255 along the optical axis R1.

For example, when a color-copied counterfeit bill 207 is fed into the conveying path 204, the light-receiving device 256 detects a large amount of fluorescence since color-copying paper includes a large amount of fluorescence-generating ingredients. By contrast, normal bills hardly include fluorescence-generating ingredients, whereby the light-receiving device 256 detects a very small amount of fluorescence. Utilizing such a half mirror 255 can make the sensor itself inexpensive, thereby cutting down the manufacturing cost. Utilizing the half mirror (light-transmitting/reflecting mirror) 255 in the paper sheet fluorescence sensor 250 is also advantageous in that the degree of freedom increases in arrangements of constituents, e.g., the ultraviolet light source 252 and the light-receiving device 256, in the housing 251.

Unless the quantity of light irradiating the bill 207 in the process of conveying is always regulated in a constant state, the bill 207 may not be inspected correctly (e.g., in terms of the kind of the bill and whether it is authentic or not). Therefore, as a means for regulation, an illumination monitor 258 constituted by a photosensor detects the light reflected by the half mirror 255. The illumination monitor 258 is accommodated in the first chamber 263 and is disposed on an extension of the optical axis R2 (see FIG. 16), so as to reliably capture the visible light reflected by the half mirror 255. The illumination monitor 258 has a lead part 258*a* secured to the driving circuit board 265. Therefore, the light emitted from the ultraviolet light source 252 is reflected by the half mirror 255 and indirectly received by the illumination monitor 258.

Figure 16:
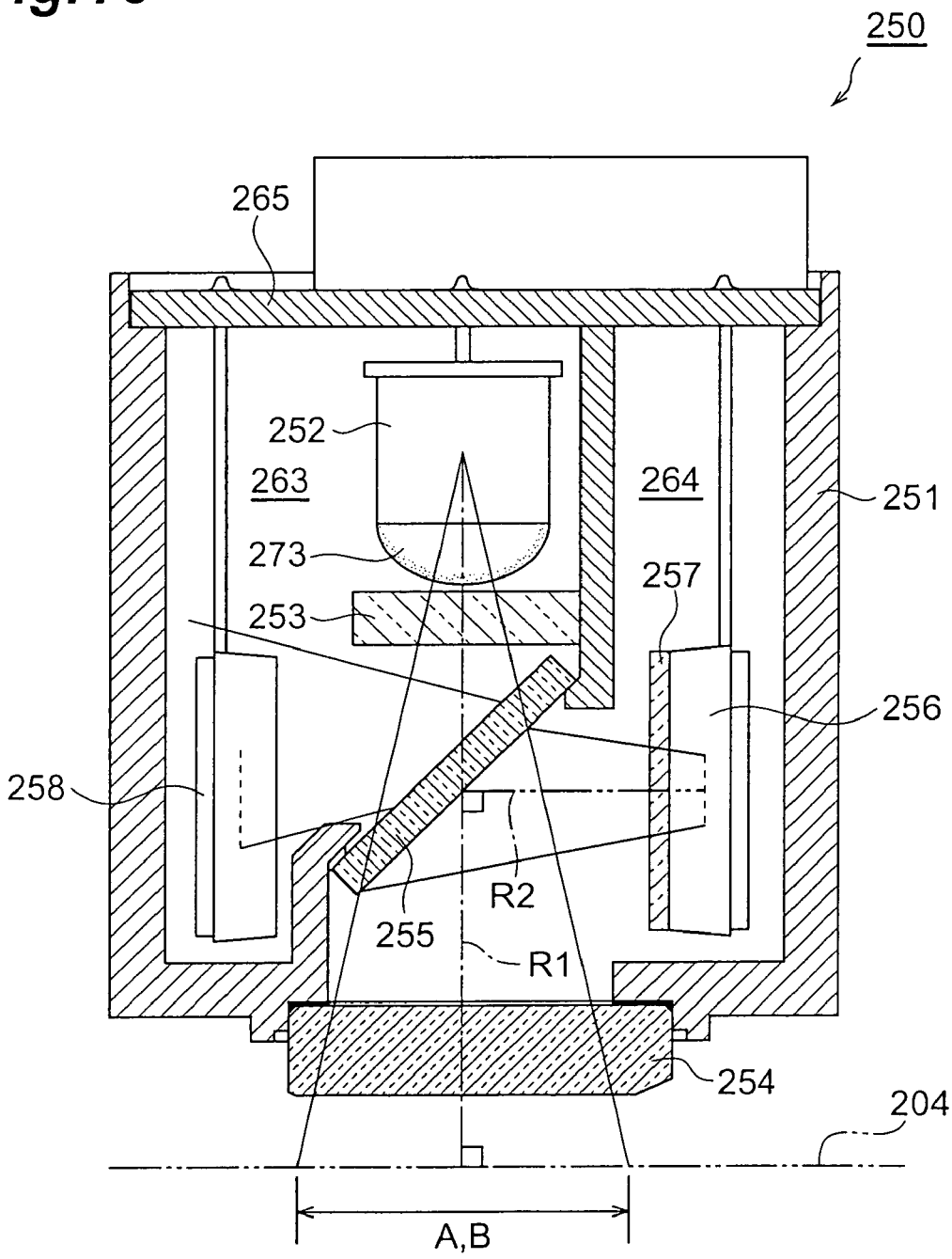
FIG. 16 is a sectional view showing an illumination area and a light-detecting area in the sensor shown in FIG. 15.

For effectively utilizing the ultraviolet ray irradiating the bill 207 in the state shown in FIG. 15, it will be preferable if an illumination area A and a light-receiving area B are substantially the same on the conveying path 204 (see FIG. 16). Therefore, the leading end of the ultraviolet LED 252 is provided with a lens part 273. When the light-receiving area B is known beforehand, the lens part 273 is utilized for adjusting the illumination angle of the ultraviolet LED 252, so as to control the light directed onto the conveying path 204. Various kinds of lens parts are selected according to characteristics of the ultraviolet LED 252 in order for the light-receiving area B to obtain an optimal brightness. Utilizing such a lens part 273 can adjust the illumination angle of the ultraviolet LED 252.

Figure 17:
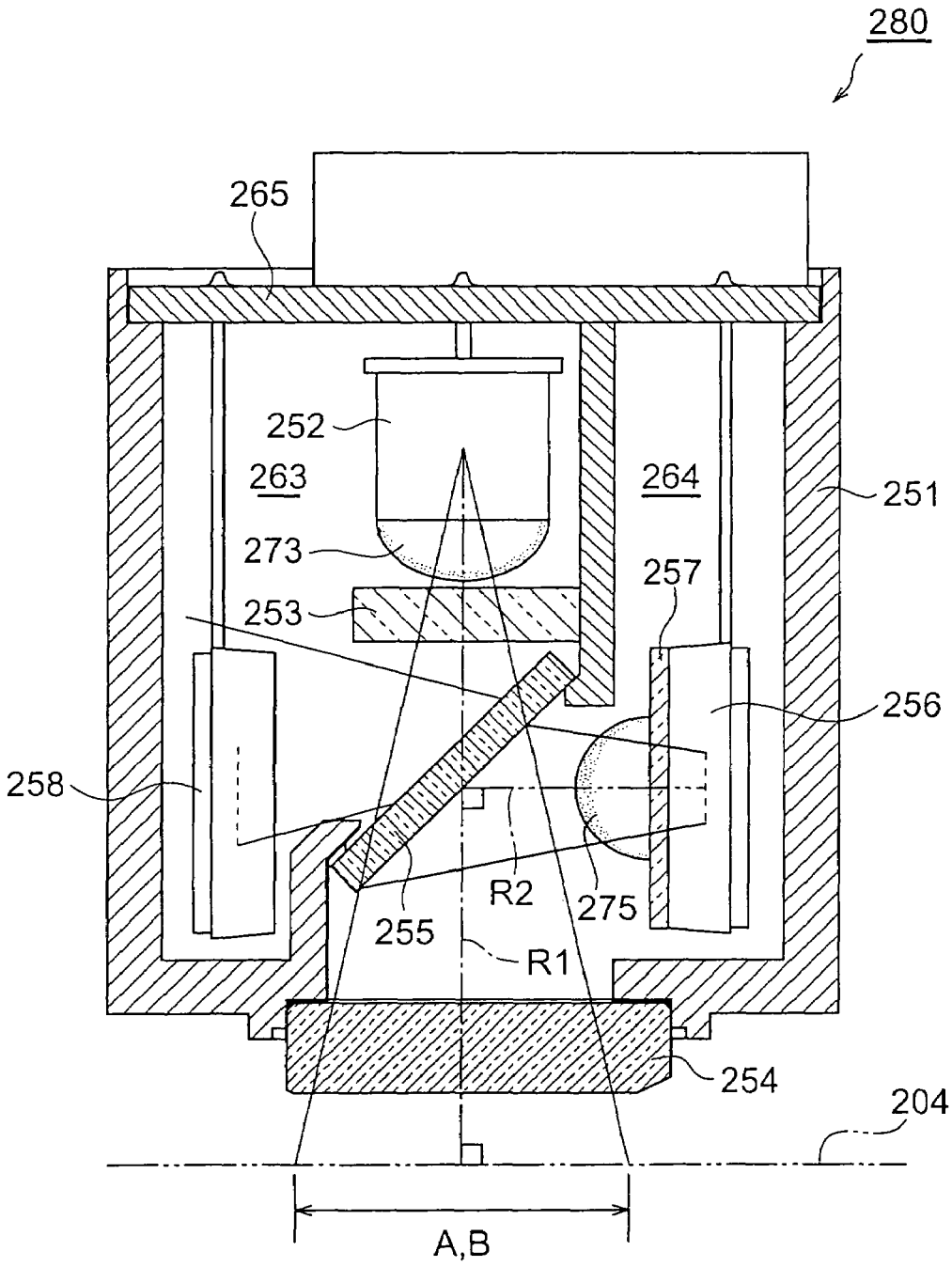
FIG. 17 is a sectional view showing a modified example of the paper sheet fluorescence sensor shown in FIG. 15.

For example, as shown in FIG. 17, another paper sheet fluorescence sensor 280 holds an ultraviolet cut filter 257 between the light-receiving device 256 and a lens part 275 so as to make the illumination area A and the light-receiving area B substantially the same on the conveying path 204 for effectively utilizing the ultraviolet ray irradiating the bill 207 (see FIG. 15). When the illumination area A is known beforehand, the lens part 275 is utilized for adjusting the light-receiving angle of the light-receiving device 256, so as to regulate the fluorescence directed toward the light-receiving part of the light-receiving device 256. Various kinds of lens parts 275 are selected according to characteristics of the light-receiving device 256 so as to attain the optimal light-receiving area B. Utilizing such a lens part 275 can produce the optimal light-receiving area B.

When a highly directive ultraviolet light source 252 is utilized, the lens part 273 is not necessary. The lens part 273 may be disposed in front of the ultraviolet light source 252 so as to be separated therefrom, whereas the lens part 275 may be disposed in front of the light-receiving device 256 so as to be separated therefrom. Though a half mirror whose ratio between light transmission and light reflection is 5/5 is explained as an example of the light-transmitting/reflecting mirror 255, various ratios are selectable in relation to the luminance of the ultraviolet light source 252 and the sensitivity of the light-receiving device 256 as a matter of course.

The paper sheet fluorescence sensors 210, 240, 250, 280 will be summarized as follows:

A paper sheet fluorescence sensor for accurately receiving fluorescence generated by a paper sheet while being less likely to be influenced by a state of the paper sheet; the paper sheet fluorescence sensor irradiating the paper sheet with light while conveying the paper sheet, and detecting the fluorescence emitted from the paper sheet; the sensor comprises:

an ultraviolet light source accommodated in a housing;

an ultraviolet-transmitting filter accommodated in the housing and disposed in front of the ultraviolet light source;

a light-transmitting/reflecting mirror, accommodated in the housing, for transmitting and reflecting light transmitted through the ultraviolet-transmitting filter so as to irradiate a conveying path of the paper sheet orthogonally with the light;

a light-receiving device, accommodated in the housing, for receiving the fluorescence emitted from the paper sheet upon irradiation with an ultraviolet ray; and an ultraviolet cut filter disposed between the light-receiving device and the light-transmitting/reflecting mirror.

This paper sheet fluorescence sensor is based on the presupposition that the paper sheet is irradiated with the ultraviolet ray, and the fluorescence emitted from the paper sheet is received by the light-receiving device so as to determine the kind of the paper sheet, whether the paper sheet is authentic or not, etc. On the conveying path, the paper sheet is not always conveyed in a constant state but maybe flopped. Also, the paper sheet itself may be wrinkled or bent. The output from the fluorescence-receiving device is required to be hard to become uneven in any of such states. Hence, for orthogonally irradiating the conveying path with the ultraviolet ray and appropriately receiving the fluorescence from the paper sheet at the same time, a light-transmitting/reflecting mirror is utilized. The light-transmitting/receiving mirror receives the light emitted from the ultraviolet light source and then transmitted through the ultraviolet-transmitting filter, and produces a light beam having an optical axis orthogonal to the conveying path of the paper sheet. The fluorescence emitted from the paper sheet illuminated with this light beam reaches the ultraviolet cut filter by way of the light-transmitting/reflecting mirror, whereas the light transmitted through the ultraviolet cut filter is received by the light-receiving device. Such a paper sheet fluorescence sensor utilizes an inexpensive light-transmitting/reflecting mirror such as a half mirror, thereby making the sensor itself inexpensive and thus cutting the manufacturing cost. Employing the light-transmitting/reflecting mirror in the paper sheet fluorescence sensor is also advantageous in that the degree of freedom increases in arrangements of constituents in the housing.

Preferably, the ultraviolet light source and the ultraviolet-transmitting filter are arranged such that the conveying path of the paper sheet is irradiated with the light reflected by the light-transmitting/reflecting mirror, whereas the light-receiving device and the ultraviolet cut filter are arranged so as to receive the fluorescence transmitted through the light-transmitting/reflecting mirror. Such a configuration, in which the paper sheet is illuminated with the light reflected by the light-transmitting/reflecting mirror whereas the fluorescence transmitted through the light-transmitting/reflecting mirror is detected by the light-receiving device, is suitable for the case where the housing of the sensor itself is horizontally elongated.

Preferably, an illumination monitor, accommodated in the housing, for receiving the light emitted from the ultraviolet light source and then transmitted through the light-transmitting/reflecting mirror is provided. Paper sheets may not be determined correctly (e.g., in terms of kinds of bills and whether they are authentic or not) unless the light irradiating the paper sheets in the process of conveying is always regulated in a constant state. For eliminating such inconveniences, the illumination monitor is disposed in the housing.

Preferably, the ultraviolet light source and the ultraviolet-transmitting filter are arranged such that the conveying path of the paper sheet is irradiated with the light transmitted through the light-transmitting/reflecting mirror, whereas the light-receiving device and the ultraviolet cut filter are arranged so as to receive the fluorescence reflected by the light-transmitting/reflecting mirror. Such a configuration, in which the paper sheet is illuminated with the light transmitted through the light-transmitting/reflecting mirror whereas the fluorescence reflected by the light-transmitting/reflecting mirror is detected by the light-receiving device, is suitable for the case where the housing of the sensor itself is vertically elongated.

Preferably, an illumination monitor, accommodated in the housing, for receiving the light emitted from the ultraviolet light source and then reflected by the light-transmitting/reflecting mirror is provided. Paper sheets may not be determined correctly (e.g., in terms of kinds of bills and whether they are authentic or not) unless the light irradiating the paper sheets in the process of conveying is always regulated in a constant state. For eliminating such inconveniences, the illumination monitor is disposed in the housing.

Preferably, the ultraviolet light source comprises a lens part for controlling the light directed to the light-transmitting/reflecting mirror such that an illumination area substantially the same as a light-receiving area on the conveying path is obtained. Such a configuration is optimal for effectively utilizing the ultraviolet ray irradiating paper sheets when receiving the fluorescence. This can be achieved in a simple and reliable manner by providing the ultraviolet light source with the lens part.

Preferably, the light-receiving device comprises a lens part for controlling the light directed to the light-receiving device by way of the light-transmitting/reflecting mirror such that a light-receiving area substantially the same as an illumination area on the conveying path is obtained. Such a configuration is optimal for effectively utilizing the ultraviolet ray irradiating paper sheets when receiving the fluorescence. This can be achieved by providing the light-receiving device with the lens part.

Industrial Applicability

The present invention relates to a paper sheet fluorescence sensor utilized for determining kinds of paper sheets such as bills and whether they are authentic or not. The paper sheet fluorescence sensor can accurately receive the fluorescence generated from paper sheets while being less likely to be influenced by states of the paper sheets.

What is claimed is:

1. A paper sheet fluorescence sensor for illuminating a paper sheet with light while conveying the paper sheet, and detecting fluorescence emitted from the paper sheet, the sensor comprising:

an ultraviolet light source accommodated in a housing for emitting light including ultraviolet light;

an ultraviolet-reflecting filter, accommodated in the housing, for reflecting the light emitted from the ultraviolet light source to illuminate a conveying path of a paper sheet orthogonally to the conveying path, the ultraviolet-reflecting filter increasing in transmission of light in response to an increase in ambient temperature;

an ultraviolet-transmitting filter disposed between the ultraviolet light source and the ultraviolet-reflecting filter; and a fluorescence-detecting device, accommodated in the housing, for receiving, by way of the ultraviolet-reflecting filter, and detecting, the fluorescence emitted from the paper sheet upon illumination with ultraviolet light.

2. The paper sheet fluorescence sensor according to claim 1, further comprising an ultraviolet-absorbing filter disposed between the ultraviolet-reflecting filter and the fluorescence-detecting device.

3. The paper sheet fluorescence sensor according to claim 1, further comprising an illumination monitor, accommodated in the housing, for detecting the light emitted from the ultraviolet light sources, transmitted by the ultraviolet-transmitting filter, and from which visible light has been removed.

4. The paper sheet fluorescence sensor according to claim 3, wherein the ultraviolet-reflecting filter is disposed in the housing at an angle so that the light emitted from the ultraviolet light source is bent by 90 degrees, the fluorescence-detecting device is disposed on an optical axis orthogonal to the conveying path, and the illumination monitor is disposed on an extension of an optical axis of the light emitted from the ultraviolet light source.

5. The paper sheet fluorescence sensor according to claim 1, wherein the ultraviolet-reflecting filter is an optical filter including a glass substrate, a vapor-deposited film on the glass substrate, and moisture between the glass substrate and the vapor-deposited film.

6. The paper sheet fluorescence sensor according to claim 5, wherein the ultraviolet-reflecting filter is disposed in the housing at an angle so that the light emitted from the ultraviolet light source is bent by 90 degrees, the fluorescence-detecting device is disposed on an optical axis orthogonal to the conveying path, and the illumination monitor is disposed on an extension of an optical axis of the light emitted from the ultraviolet light source.

7. The paper sheet fluorescence sensor according to claim 5, further comprising an ultraviolet-absorbing filter disposed between the ultraviolet-reflecting filter and the fluorescence-detecting device.

8. The paper sheet fluorescence sensor according to claim 5, further comprising an illumination monitor, accommodated in the housing, for detecting the light emitted from the ultraviolet light source, transmitted by the ultraviolet-transmitting filter, and from which visible light has been removed.

9. The paper sheet fluorescence sensor according to claim 8, wherein the ultraviolet-reflecting filter is disposed in the housing at an angle so that the light emitted from the ultraviolet light source is bent by 90 degrees, the fluorescence-detecting device is disposed on an optical axis orthogonal to the conveying path, and the illumination monitor is disposed on an extension of an optical axis of the light emitted from the ultraviolet light source.

10. The paper sheet fluorescence sensor according to claim 5, wherein the ultraviolet light source comprises a lens for controlling the light directed to the ultraviolet-reflecting filter to yield an illumination area substantially the same as a light-receiving area on the conveying path.

11. The paper sheet fluorescence sensor according to claim 5, wherein the fluorescence-detecting device comprises a lens for controlling the fluorescence transmitted through the ultraviolet-reflecting filter toward the fluorescence-detecting device to yield a light-receiving area substantially the same as an illumination area on the conveying path.

12. The paper sheet fluorescence sensor according to claim 1, wherein the ultraviolet light source comprises a lens for controlling the light directed to the ultraviolet-reflecting filter to yield an illumination area substantially the same as a light-receiving area on the conveying path.

13. The paper sheet fluorescence sensor according to claim 1, wherein the fluorescence-detecting device comprises a lens for controlling the fluorescence transmitted through the ultraviolet-reflecting filter toward the fluorescence-detecting device to yield a light-receiving area substantially the same as an illumination area on the conveying path.

14. The paper sheet fluorescence sensor according to claim 1, wherein the ultraviolet-reflecting filter is disposed in the housing at an angle so that the light emitted from the ultraviolet light source is bent by 90 degrees, the fluorescence-detecting device is disposed on an optical axis orthogonal to the conveying path, and the illumination monitor is disposed on an extension of an optical axis of the light emitted from the ultraviolet light source.

* * * * *